US006543759B2

(12) United States Patent
Yamaguchi et al.

(10) Patent No.: US 6,543,759 B2
(45) Date of Patent: Apr. 8, 2003

(54) PAPER FEEDER FOR USE IN IMAGE FORMING APPARATUS

(75) Inventors: Yoshihiro Yamaguchi, Habikino (JP); Masami Fuchi, Katano (JP); Nobuyuki Kashiwagi, Ikoma (JP); Kiyonori Yamamoto, Higashiosaka (JP); Masaki Higashiyama, Daito (JP)

(73) Assignee: Kyocera Mita Corporation, Osaka (JP)

( * ) Notice: Subject to any disclaimer, the term of this patent is extended or adjusted under 35 U.S.C. 154(b) by 72 days.

(21) Appl. No.: 09/789,269

(22) Filed: Feb. 20, 2001

(65) Prior Publication Data

US 2001/0017441 A1 Aug. 30, 2001

(30) Foreign Application Priority Data

Feb. 23, 2000 (JP) ..... 2000-045913
Feb. 23, 2000 (JP) ..... 2000-045914
Feb. 23, 2000 (JP) ..... 2000-046320

(51) Int. Cl.[7] ..... B65H 3/14
(52) U.S. Cl. ..... 271/98; 271/104
(58) Field of Search ..... 271/98, 97, 94, 271/104

(56) References Cited

U.S. PATENT DOCUMENTS 5,135,213 A * 8/1992 Malachowski et al. ..... 271/104
5,150,892 A * 9/1992 Shimizu ..... 271/98
5,344,133 A * 9/1994 Jantsch et al. ..... 271/94
5,915,683 A * 6/1999 Otsuka ..... 271/94
5,988,629 A * 11/1999 Burlew etal. ..... 371/98 X

FOREIGN PATENT DOCUMENTS

EP 0361259 A1 * 4/1990 ..... 271/98
JP 06-107347 4/1994
JP 10-226426 8/1998

* cited by examiner

*Primary Examiner*—David H. Bollinger
(74) *Attorney, Agent, or Firm*—Jordan and Hamburg LLP

(57) ABSTRACT

A paper feeder is able to properly separate and convey the uppermost sheet of paper from sheets stacked beneath it in a paper bin while effectively preventing multiple paper sheet feeds and other paper feed problems. The paper feeder includes a paper separator for lifting upper sheets, and separating the uppermost sheet from the sheet immediately beneath it by blowing air against an upper-forward end of a stack of paper loaded in a paper bin, and a vacuum paper carrier for holding the uppermost sheet by suction and carrying it. The paper separator has lifting nozzles for lifting side ends of the upper sheets, by blowing air toward side portions, excluding a central portion, of the stack of paper loaded in the paper bin.

32 Claims, 13 Drawing Sheets

PAPER FEEDER FOR USE IN IMAGE FORMING APPARATUS

BACKGROUND OF THE INVENTION

This invention relates to paper feeders provided in image forming apparatus, such as copying machines, facsimile machines and printers.

Japanese Unexamined Patent Publication No. 6-107347 discloses an example of a conventional paper feeder which employs a vacuum paper carrier for holding the uppermost sheet of paper by suction and feeding it to an image-forming section. In this paper feeder, a blower duct in which a lifting nozzle for lifting the uppermost sheet of a stack of paper loaded in a paper bin by blowing air almost horizontally toward an upper-forward end of the stack and a separating nozzle for separating the uppermost sheet from a sheet immediately beneath the uppermost sheet by blowing air obliquely upward toward between the two sheets of paper are provided is located at a lower-front part of the vacuum paper carrier.

On the other hand, Japanese Unexamined Patent Publication No. 10-226426 discloses an image forming apparatus in which a blower blows air against a forward end of upper sheets of paper stacked on a paper tray to lift the uppermost sheet and a paper sucker sucks and transports the uppermost sheet. This image forming apparatus comprises an air-suction-type paper feeder which is constructed such that an upper end portion of a rear paper end aligning plate provided to stand at a rear part of the paper tray is curved or slanted in a paper-feeding direction, and an air flow produced by the blower is reversed by the upper end portion of the rear paper end aligning plate to hold down a rear part of a top surface of the uppermost sheet.

In recent years, recycled paper is widely used in copying machines, for example, from the viewpoint of environmental protection. Among various types of recycled paper, some are apt to develop a problem that cut ends of individual sheets stick together due to inclusion of impurities in raw paper material, for instance. When such types of recycled paper are used, there can arise a problem that even if the paper feeder provided with the blower duct is used as disclosed in Japanese Unexamined Patent Publication No. 6-107347, paper misfeeds or multiple paper sheet feeds would occur due to too low a pressure of air, or too high a pressure of air, blown from the lifting nozzle, respectively.

More specifically, in order to separate and smoothly feed the uppermost sheet of a stack of recycled paper, it is necessary to maintain a properly increased pressure of air blown against the upper-forward end of the stack from the lifting nozzle of the blower duct. If the pressure of blown air is too high, however, sheets immediately beneath the uppermost sheet are likely to lift together with the uppermost sheet and, as a consequence, even if air is blown obliquely upward from the separating nozzle for separating the uppermost sheet, it could not be separated from the sheets beneath it, resulting in an increase in the possibility of multiple paper sheet feeds in which more than one sheet of paper is fed simultaneously.

Especially when the paper has a high electrical resistance and is prone to accumulate electrostatic-charges, the uppermost sheet and one or more sheet of paper beneath it stick together by electrostatic force and these sheets are likely to lift together. This could often cause a multiple paper sheet feed problem in which multiple sheets of paper are sucked and transported at the same time by the vacuum paper carrier.

If the pressure of air blown against the upper-forward end of the stack from the lifting nozzle is set to a low level to prevent the multiple paper sheet feed problem, there could arise such a paper transport problem that the vacuum paper carrier can not attract the uppermost sheet as it can not be separated and lifted from the stack of recycled paper.

In the paper feeder provided with the rear paper end aligning plate disclosed in Japanese Unexamined Patent Publication No. 10-226426, on the other hand, the upper end portion of the rear paper end aligning plate provided to stand at the rear part of the paper tray is curved or slanted in the paper-feeding direction to allow a stream of air blown by the blower against an upper-forward end of a stack of paper to flow up to a rear end of the paper, and the air flow is reversed along the curved or slanted upper end portion of the rear paper end aligning plate to hold down the rear part of the top surface of the uppermost sheet. This construction has an advantage that the uppermost sheet can be easily separated from sheets immediately beneath it as the blown air is caused to expand between them.

Even if the paper feeder is so constructed as to indirectly hold the rear part of the top surface of the uppermost sheet by the reversed air flow as described above, however, it is impossible to retain the rear part of the sheet in a stable fashion. If the pressure of air blown by the blower against the upper-forward end of the stack of paper is too high, the rear part of upper sheets could flutter due to the stream of air passing between the sheets. This would develop a problem that the sheets of paper are apt to become misaligned, causing oblique paper feeds or folded sheet ends, for instance. If the pressure of air blown by the blower against the upper-forward end of the stack of paper is too low on the contrary, it becomes impossible to properly separate the sheets of paper, causing a multiple paper sheet feed problem in which multiple sheets of paper are attracted by the paper sucker and transported.

SUMMARY OF THE INVENTION

It is an object of the present invention to provide a paper feeder which is free from the problems residing in the prior art.

It is another object of the invention to provide a paper feeder which can properly separate and convey the uppermost sheet of paper from sheets stacked beneath it in a paper bin and effectively prevent oblique paper feeds and other paper feed problems caused by fluttering of a rear end of each sheet of paper.

According to an aspect of the invention, a paper feeder comprises a paper separator for lifting upper sheets of paper and separating the uppermost sheet from the sheet immediately beneath it by blowing air against an upper-forward end of a stack of paper loaded in a paper bin, and a vacuum paper carrier for holding the uppermost sheet by suction and carrying it. The paper separator has a lifting nozzle for lifting side ends of the upper sheets by blowing air toward side portions, excluding a central portion, of the stack of paper loaded in the paper bin.

According to another aspect of the invention, a paper feeder in which sheets of paper are separated and fed one after another from a stack of paper comprises a plurality of paper-feed belts arranged at right angles to paper-feeding direction and driven in the paper-feeding direction, the paper-feed belts having air-passing capability, a vacuum paper sucker for sucking a sheet which has come closest to the paper-feed belts and holding the sheet onto the paper-feed belts, and an elastic friction member which is located between the adjacent paper-feed belts and exerts frictional resistance on the sheet sucked onto the paper-feed belts by going into contact with the sheet from its side facing the stack of paper, the frictional resistance acting in a direction opposite to the paper-feeding direction.

According to still another aspect of the invention, a paper feeder comprises a paper separator for lifting upper sheets of paper and separating the lifted uppermost sheet from the sheet immediately beneath it by blowing air against an upper-forward end of a stack of paper loaded in a paper bin, a vacuum paper carrier for holding the uppermost sheet by suction and carrying it, a first paper pusher for pushing down a rear central portion of the uppermost sheet at the top of the stack of paper loaded in the paper bin, and a second paper pusher for pushing down rear left and right portions of the uppermost sheet with a smaller force than the first paper pusher.

According to yet another aspect of the invention, a paper feeder comprises a lifting nozzle for lifting upper sheets of paper from a stack of paper loaded in a paper bin by blowing air against an upper-forward end of the stack of paper, and a vacuum paper carrier for holding the lifted uppermost sheet by suction and carrying it. The lifting nozzle has a narrow opening portion for blowing air toward a narrow area including the uppermost part of the stack of paper loaded in the paper bin and a wide opening portion for blowing air toward a wide area including the uppermost part of the stack of paper.

These and other objects, features, aspects, and advantages of the present invention will become more apparent from the following detailed description of the preferred embodiments/examples with reference to the accompanying drawings.

DETAILED DESCRIPTION OF THE PREFERRED EMBODIMENTS OF THE INVENTION

Figure 1:
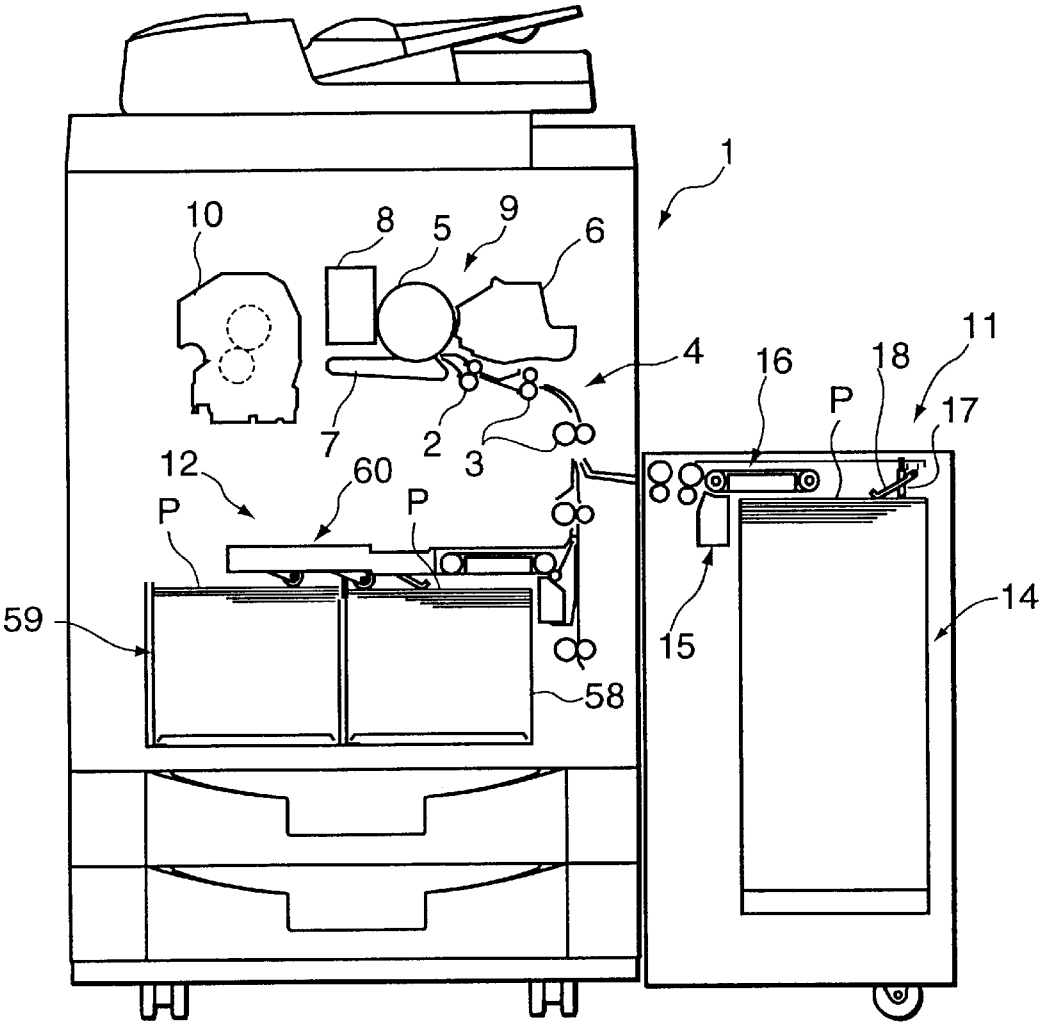
FIG. 1 is a general configuration diagram of an image forming apparatus provided with paper-feed mechanisms according to a preferred embodiment of the invention.

FIG. 1 is a general configuration diagram of an image forming apparatus 1 (copying machine) provided with paper-feed mechanisms according to the invention. The image forming apparatus 1 comprises a paper transport mechanism 4 including registration rollers 2 and feed rollers 3, an image-forming section 9 including a photosensitive drum 5, a developing unit 6, an image-transfer belt 7 and a cleaning unit 8, and a fixing section 10 including fixing rollers.

The image forming apparatus 1 further comprises an external paper-feed unit 11 which is attached to a side surface of the body of the image forming apparatus 1 and an internal paper-feed unit 12 which is provided beneath the image-forming section 9, so that sheets of paper selectively supplied from the external paper-feed unit 11 or the internal paper-feed unit 12 can be fed to the image-forming section 9 through the paper transport mechanism 4.

Figure 2:
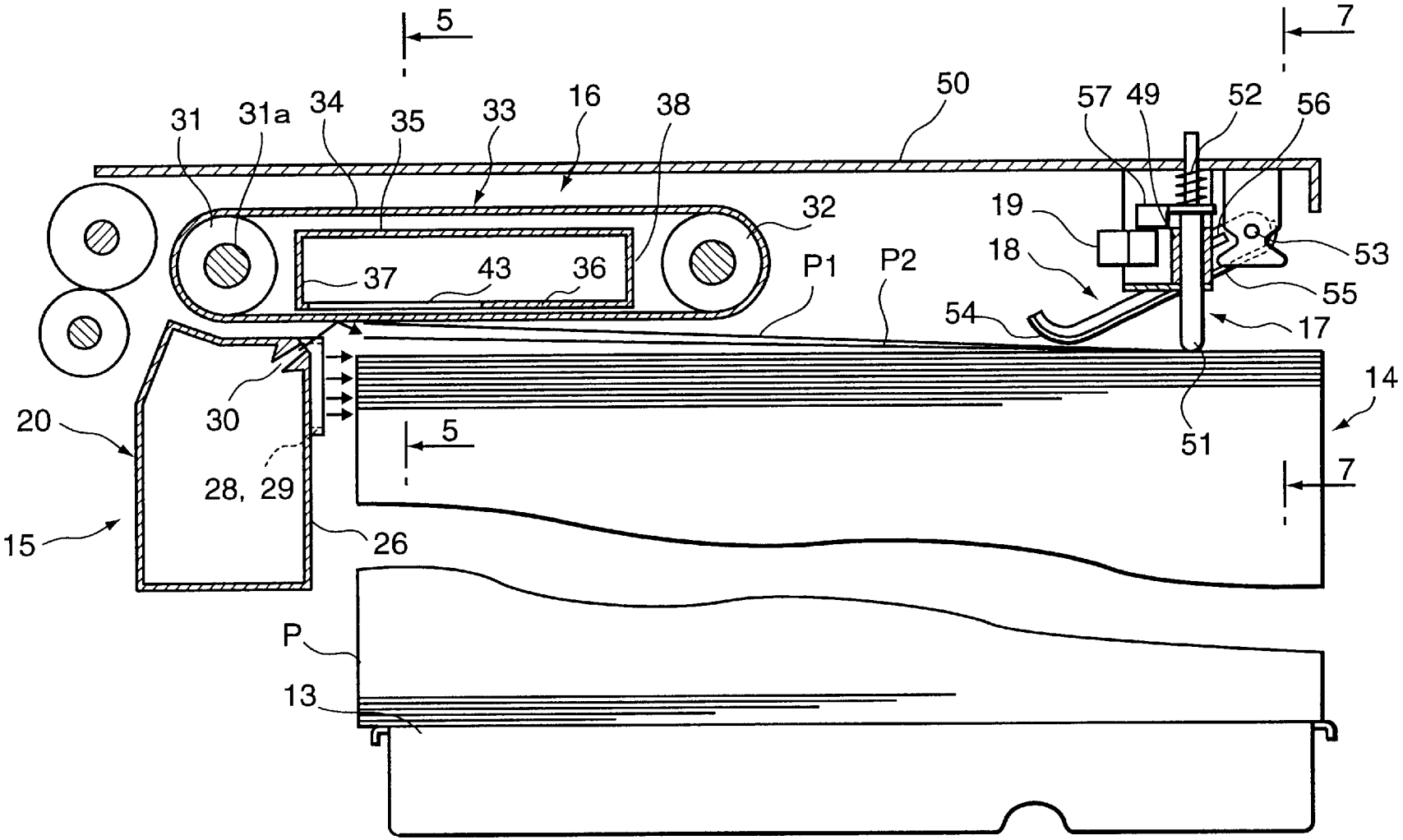
FIG. 2 is a cross-sectional view showing a construction of a paper-feed unit.

As shown in FIG. 2, the external paper-feed unit 11 includes a paper bin 14 provided with a paper stacker plate 13 which can be raised and lowered by an unillustrated elevation drive mechanism, a paper separator 15 which lifts upper sheets of paper P1, P2, for example, and separates the uppermost sheet P1 from the second sheet P2 by blowing air against an upper-forward end of a stack of paper P loaded in the paper bin 14, and a vacuum paper carrier 16 for holding the uppermost sheet P1 by suction and carrying it to the paper transport mechanism 4.

The paper-feed unit 11 further includes a first paper pusher 17 for pushing down a rear central portion of the uppermost sheet P1 at the top of the stack P loaded in the paper bin 14, a pair of second paper pushers 18 for pushing down rear left and right portions of the uppermost sheet P1 with a smaller force than the first paper pusher 17, an upper-limit detecting switch 19 made of a photosensor for detecting the position of an upper surface of the stack of paper P loaded in the paper bin 14, and a supporting frame 50 for supporting the above elements 17–19.

Figure 3:
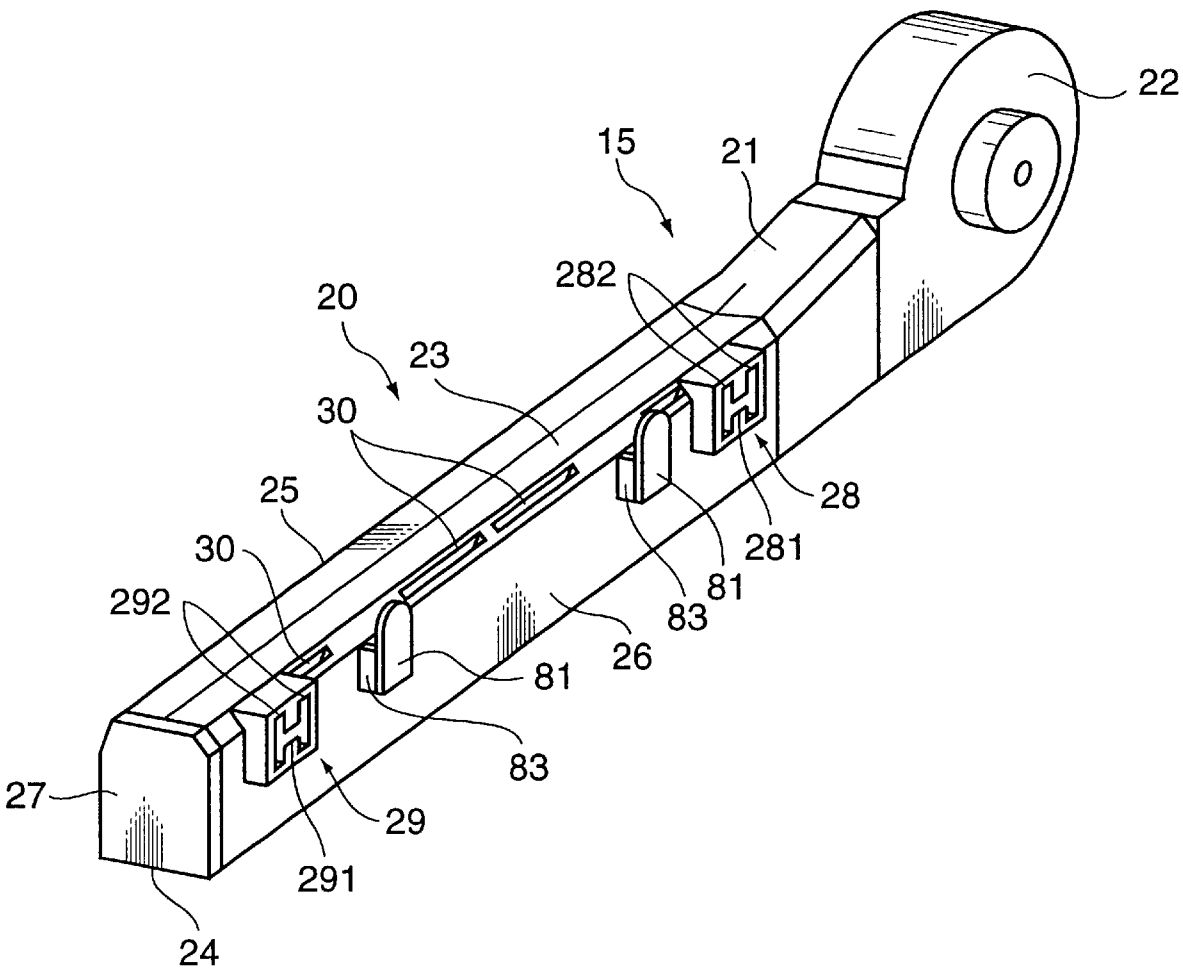
FIG. 3 is a perspective view showing a construction of a paper separator.

The paper separator 15 of the paper-feed unit 11 has an air duct 20 extending in a direction perpendicular to paper transport direction (feed direction) at a position facing the upper-forward end of the stack of paper P loaded in the paper bin 14, and a blower 22 is joined to an upstream end of the air duct 20 via an interconnecting duct 21 as shown in FIG. 3.

The air duct 20 has an upper wall 23, a bottom wall 24, a pair of side walls 25, 26 and an end plate 27 closing a downstream end of the air duct 20. A pair of lifting nozzles 28, 29, one located close to the upstream end of the air duct 20 and the other close to the downstream end, are formed in the side wall 26 which is directed opposite to the paper-feeding direction, facing the forward end of the stack of paper P. The lifting nozzles 28, 29 are individually formed into an H shape each having a first opening portion 281, 291 (narrow opening portion) of a specific length extending in a longitudinal direction of the side wall 25 and a pair of second opening portions 282, 292 (wide opening portions) vertically extending at both ends of the first opening portion 281, 291.

The first opening portions 281, 291 of the individual lifting nozzles 28, 29 are constructed such that their upper width (horizontal dimension) is relatively large. With this construction, the lifting nozzles 28, 29 blow air almost horizontally toward narrow areas including uppermost parts of the stack of paper P loaded in the paper bin 14 and, as a consequence, upper sheets of the stack of paper P including the sheets P1 and P2 are intensively loosened and separated from each other.

Also, the second opening portions 282, 292 of the individual lifting nozzles 28, 29 are constructed such that their upper width (horizontal dimension) is relatively large. With this construction, the second opening portions 282, 292 blow air almost horizontally toward wider areas including the uppermost parts of the stack of paper P, so that they lift the upper sheets P1 and P2 to a specific height where air streams produced by separating nozzles 30 reach, and the uppermost sheet P1 can be lifted up to a sucking part of the vacuum paper carrier 16.

The separating nozzles 30 are formed along an end of the air duct 20 where its side wall 25 and upper wall 23 meet. These separating nozzles 30 are provided near the upstream end of the air duct 20, at the central part of the air duct 20, and near the downstream end of the air duct 20. The separating nozzles 30 are slitlike openings extending in the longitudinal direction of the air duct 20, each having a specific length. As illustrated in FIG. 2, the separating nozzles 30 blow air obliquely upward against the bottom of the vacuum paper carrier 16 and reflected streams of air are used to separate the uppermost sheet P1 sucked by the vacuum paper carrier 16 from the sheet P2 immediately beneath the sheet P1.

Figure 4:
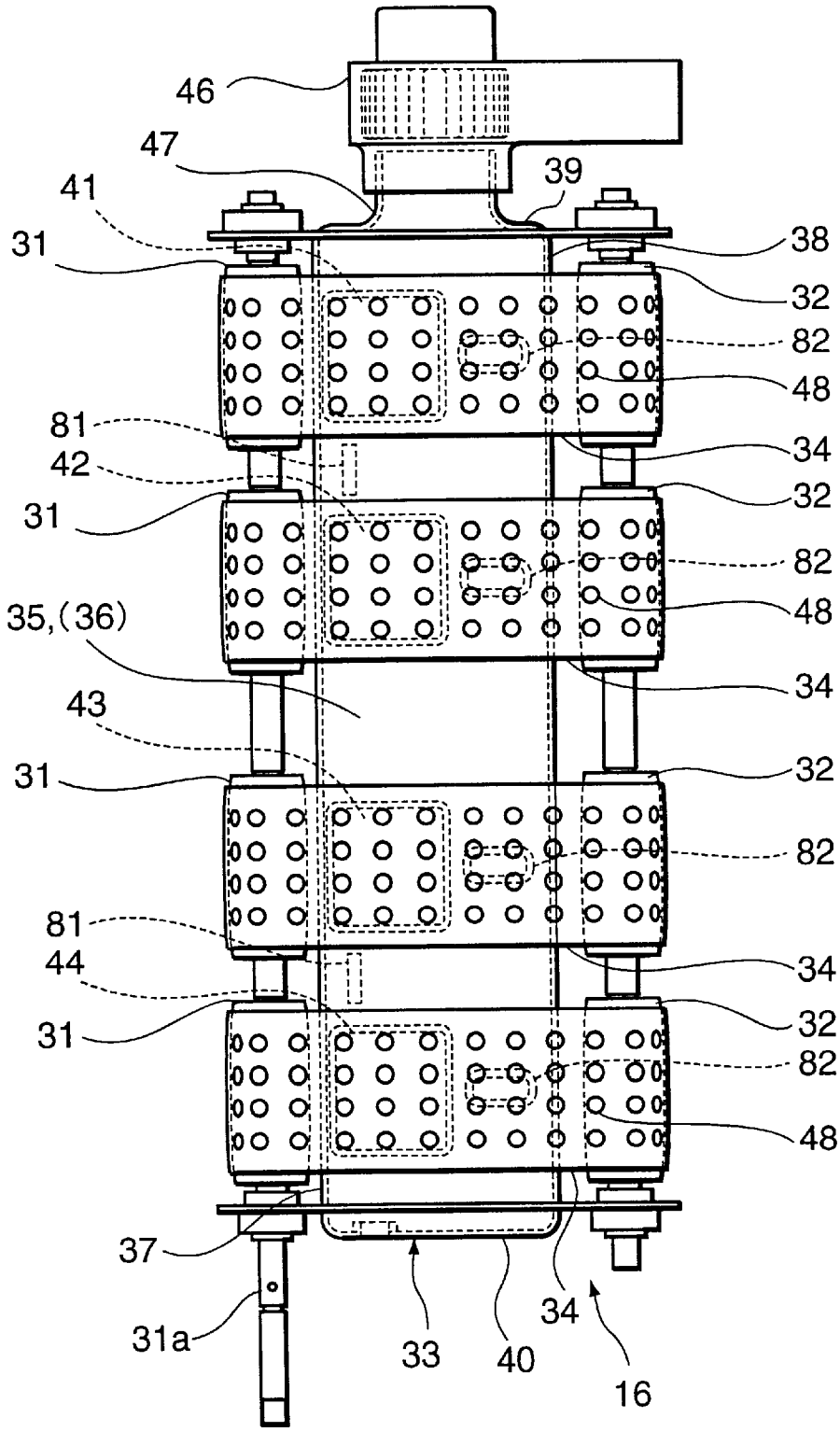
FIG. 4 is a plan view showing a construction of a vacuum paper carrier.

As shown in FIGS. 2 and 4, the vacuum paper carrier 16 includes four each driving rollers 31 and driven rollers 32 aligned side by side at right angles to the paper-feeding direction with a specific distance in between, a vacuum duct 33 placed between the driving rollers 31 and the driven rollers 32, and four paper-feed belts 34 mounted around individual pairs of the driving and driven rollers 31, 32. As a drive shaft 31*a* mounted rotatably together with the driving rollers 31 is turned by unillustrated driving means including an electric motor, for example, the paper-feed belts 34 are driven to advance the sheet P1 in the paper-feeding direction.

The vacuum duct 33 is formed into a boxlike shape having a top wall 35, a bottom wall 36, a front wall 37 and a rear wall 38 provided on forward and rearward sides of the paper-feeding direction, as well as side walls 39 and 40 provided on right and left sides of the paper-feeding direction, respectively. Four suction holes 41–44 are formed in the bottom wall 36 at locations corresponding to the paper-feed belts 34, as illustrated.

A vacuum pump 46 is connected to the side wall 39 of the vacuum duct 33 via a tubular joint 47 on the left side of the paper-feeding direction, that is, at a location corresponding to the upstream end of the air duct 20 to which the blower 22 is joined. The vacuum pump 46, the tubular joint 47 and the vacuum duct 33 together constitute a vacuum paper sucker which produces a negative pressure by drawing air from within the vacuum duct 33 to attract a sheet of paper to the bottom side of the paper-feed belts 34 by suction.

Figure 5:
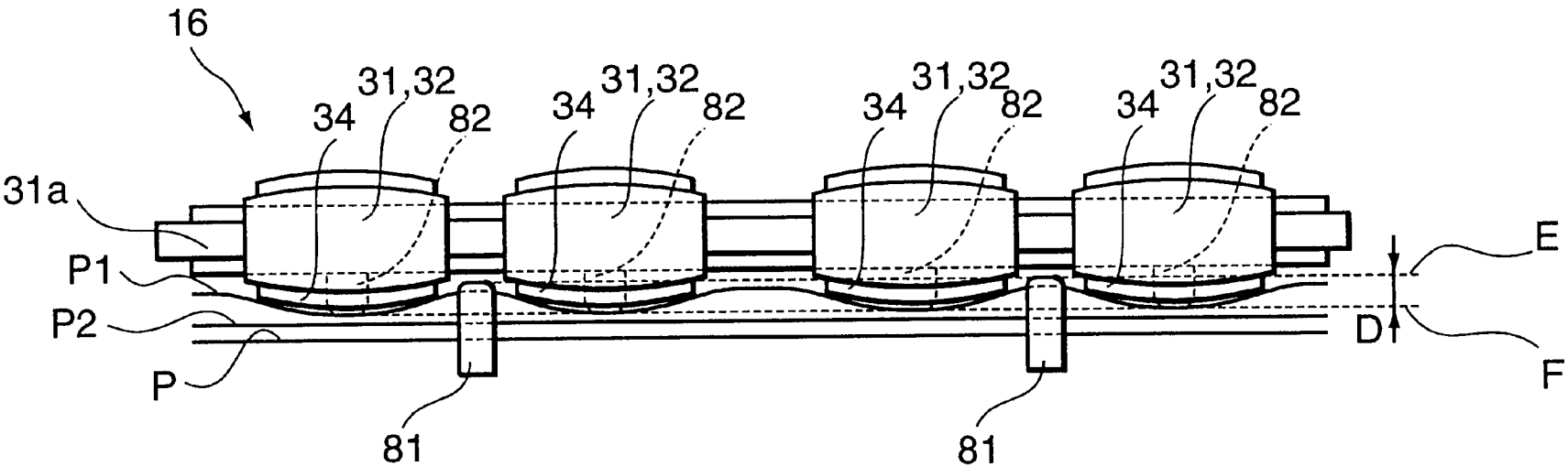
FIG. 5 is a cross-sectional view taken along the line 5—5 in FIG. 2.

Each of the driving and driven rollers 31, 32 has a barrellike shape swelling at the middle of its length as shown in FIG. 5. The paper-feed belts 34 having a thickness of about 0.5 to 1.5 mm are made of synthetic rubber material, for instance, in which a number of through holes 48 are made. When the paper-feed belts 34 are mounted around the driving and driven rollers 31, 32, the bottom side of each paper-feed belt 34 swells at the middle of its width downward toward the stack of paper P.

There are formed ribs 82 on the bottom wall 36 of the vacuum duct 33 on the upstream side of the individual suction holes 41–44 with respect to the paper-feeding direction. These ribs 82 come in contact with the individual paper-feed belts 34, causing their bottom side to swell downward.

The paper-feed unit 11 is provided with means for accelerating separation of the sheet P1 located at the top of the stack of paper P from the sheet P2 immediately beneath the sheet P1, or a pair of left and right retard members (frictional contact members) 81 which complementarily serve to separate the sheets P1 and P2, for instance, when their separation from each other has been incomplete.

Figure 6:
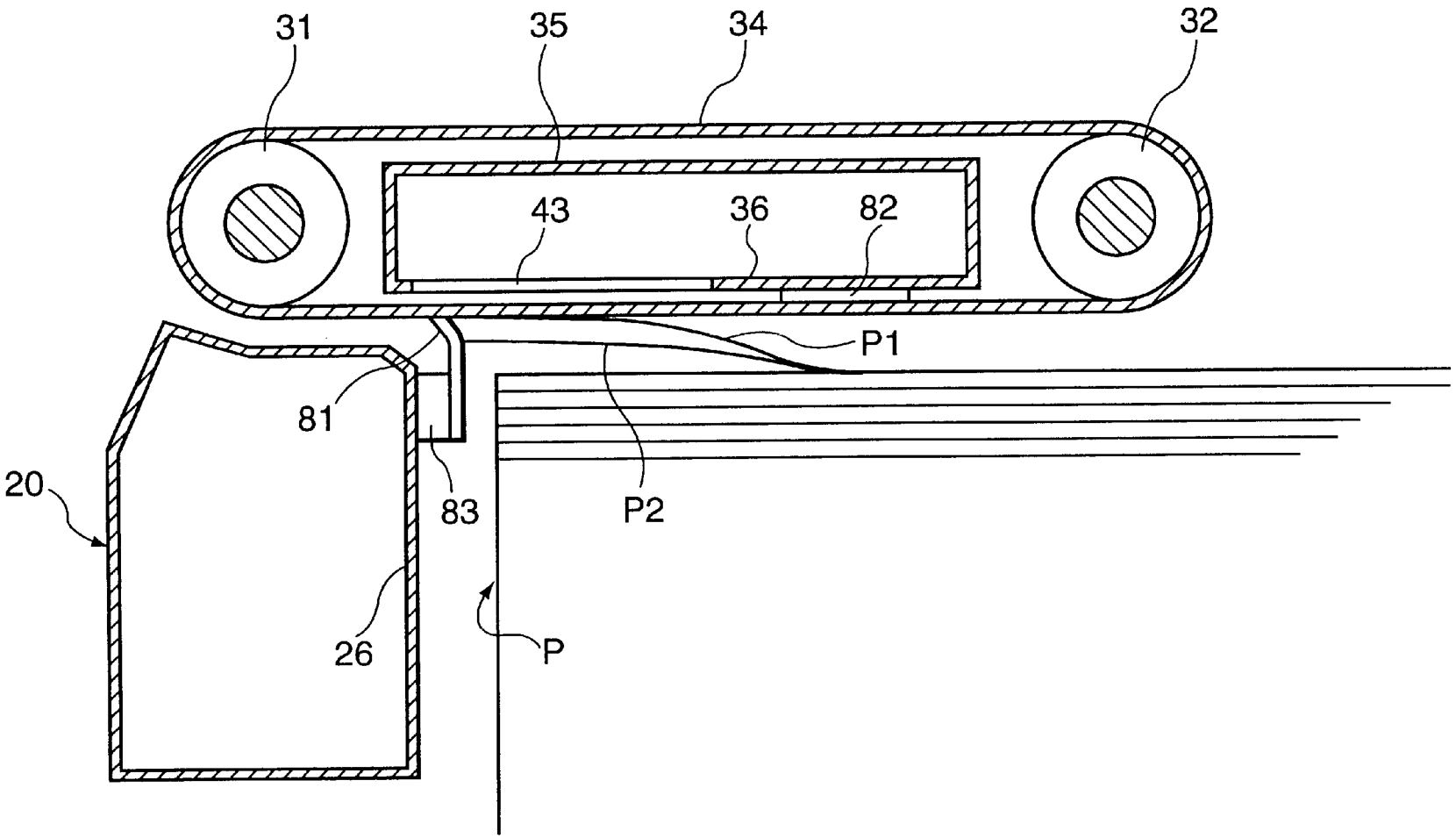
FIG. 6 is a cross-sectional view showing provision of retard members.

The retard members 81 are made of a material having a proper level of elasticity and a high friction coefficient, such as rubber material having a thickness of about 1 to 3 mm. These retard members 81 are fitted to the side wall 26 of the air duct 20 on its side facing the stack of paper P via fixing tabs 83 as illustrated in FIGS. 5 and 6. The left and right retard members 81 are disposed side by side in a direction perpendicular to the paper-feeding direction in such a way that they are located just between the adjacent paper-feed belts 34 in left-right symmetry with respect to a center line (axis of symmetry) of each sheet passing the center of its width.

The retard members 81 are positioned such that their upper end position E is located higher than their contact position F with the uppermost sheet P1 sucked by the paper-feed belts 34 by a distance D. If the paper-feed belts 34 suck multiple sheets, P1 and P2 for example, and carry them out of the paper bin 14, upper ends of the retard members 81 come into contact with the sheets P1 and P2 and become elastically deformed. Consequently, the upper ends of the retard members 81 produce frictional resistance which acts against forward movement the sheet located closer to the stack of paper P, or the second sheet P2 in this case, thereby separating the uppermost sheet P1 from the second sheet P2.

Figure 7:
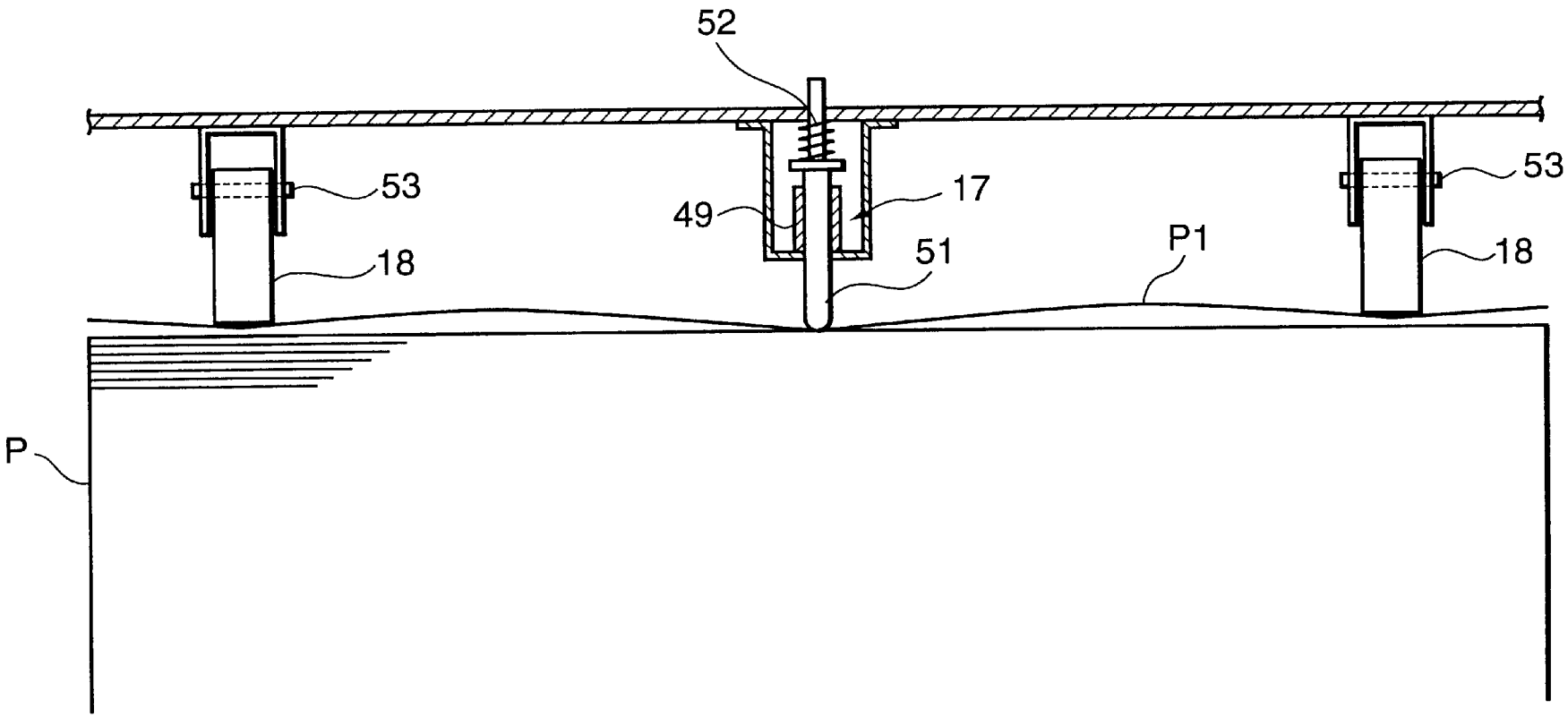
FIG. 7 is a cross-sectional view taken along the line 7—7 in FIG. 2.

The earlier-mentioned first paper pusher 17 includes, as shown in FIGS. 2 and 7, a pushing bar 51 supported by a elevation guide 49 which is located above the rear central portion of the stack of paper P loaded in the paper bin 14 for moving the pushing bar 51 up and down, and a compression coil spring 52 for biasing the pushing bar 51 downward. The first paper pusher 17 is constructed such that a lower end of the pushing bar 51 presses against the rear central portion of the uppermost sheet P1 with a pushing force corresponding to a biasing force exerted by the compression coil spring 52.

The pushing force of the first paper pusher 17 is controlled to such a strength that it just allows the uppermost sheet P1 to be fed by the vacuum paper carrier 16 while holding its rear central portion onto the sheet P2 immediately beneath as the pressure of air blown from the paper separator 15 against the upper-forward end of the stack of paper P prevents the uppermost sheet P1 from ascending.

The second paper pushers 18 are made of synthetic resin members having a specific width, for instance, which are sustained by pivot shafts 53 swingably about them. Curved portions 54 are formed at lower ends of the second paper pushers 18 as depicted in FIG. 2. As the lower ends (curved portions 54) of the second paper pushers 18 push against the uppermost sheet P1 with their own weight on the rearward side (upstream side) of the paper-feeding direction with respect to the position of the pivot shafts 53, the second paper pushers 18 hold down the rear left and right portions of the uppermost sheet P1 with a smaller force than the first paper pusher 17.

Pushing force of the second paper pushers 18 is controlled to such a strength that it allows the uppermost sheet P1 to be fed by the vacuum paper carrier 16 and the rear left and right portions of the uppermost sheet P1 to slightly ascend under the pressure of air blown from the paper separator 15. The second paper pushers 18 are situated approximately on lines extended downstream in the direction of air streams blown from the lifting nozzles 28, 29 of the paper separator 15. The second paper pushers 18 have projecting stopper tabs 56 which limit upward swinging motion of the second paper pushers 18 by contacting projections 55 formed on mounting brackets of the second paper pushers 18.

The earlier-mentioned upper-limit detecting switch 19 detects the position of the upper surface of the stack of paper P loaded in the paper bin 14 by detecting the position of a detection plate 57 attached to the pushing bar 51 of the first paper pusher 17. When sheets of paper have been successively fed from the paper bin 14 and it has been determined that the upper surface of the stack of paper P has lowered to a specific position based on a sensing signal from the upper-limit detecting switch 19, a control signal which causes the stacker plate 13 to ascend is output to its elevation drive mechanism, whereby the upper surface of the stack of paper P is moved up to its upper limit according to consumption of sheets of paper.

In the above-described construction, when feeding a sheet from the paper-feed unit 11 to the image-forming section 9 of the image forming apparatus 1, the lifting nozzles 28, 29 of the paper separator 15 blow air for lifting the upper sheets P1, P2, for example, against the upper-forward end of the stack of paper P and the separating nozzles 30 blow air for separating the uppermost sheet P1 from the sheet P2 immediately beneath while holding down the rear central portion and rear left and right portions of the stack P in the paper bin 14 with the first and second paper pushers 17, 18.

Figure 10:
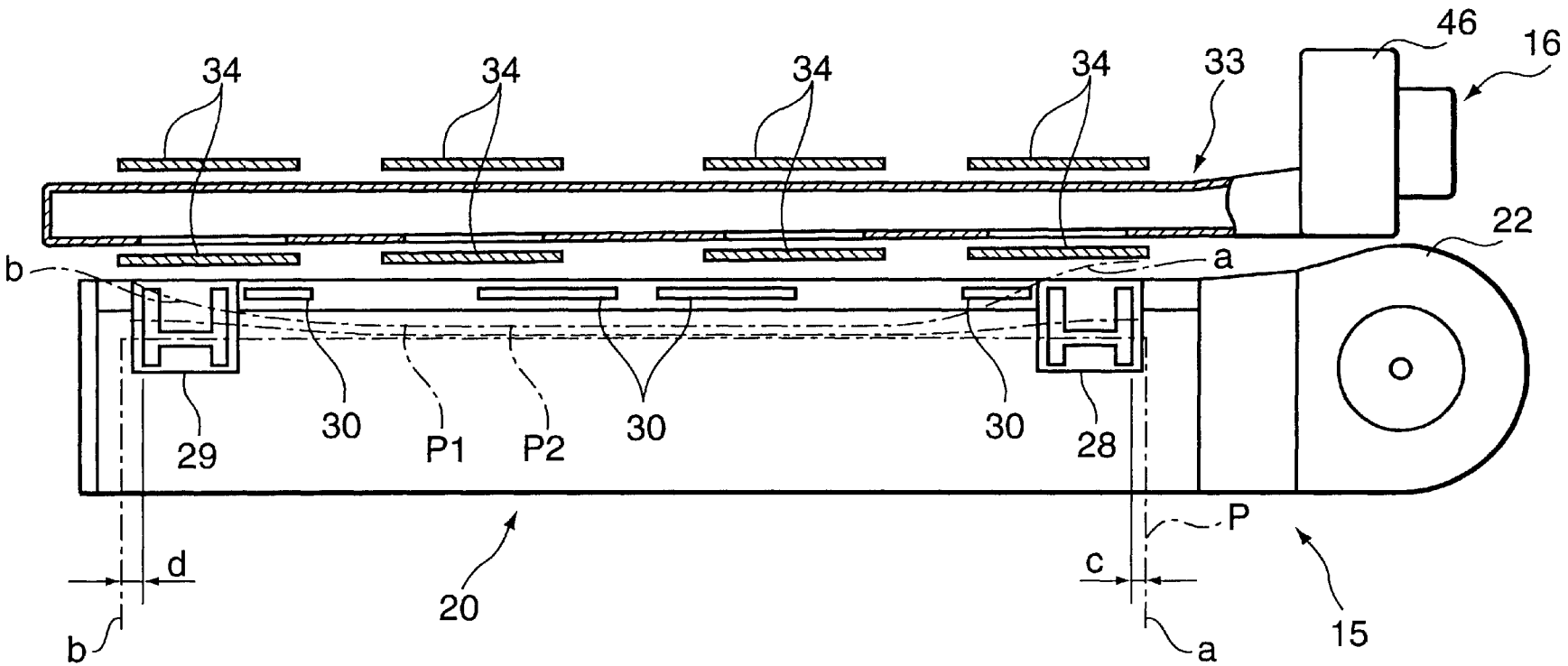
FIG. 10 is an explanatory diagram showing how sheets of paper are lifted.

As the lifting nozzles 28, 29 of the paper separator 15 blow air against the upper-forward end of the stack P, the pressure of air blown toward left and right end portions of the stack P lifts left and right ends of the upper sheets P1, P2, for example, causing the sheets P1, P2 to warp with some difference between their curvatures as illustrated in FIG. 10. As a result of this difference in curvature, there occurs a force which causes the left and right ends of the sheets P1, P2 to slide sideways (left or right), whereby the sheets P1, P2 are separated from each other even when they stick together by electrostatic force.

Figure 11A:
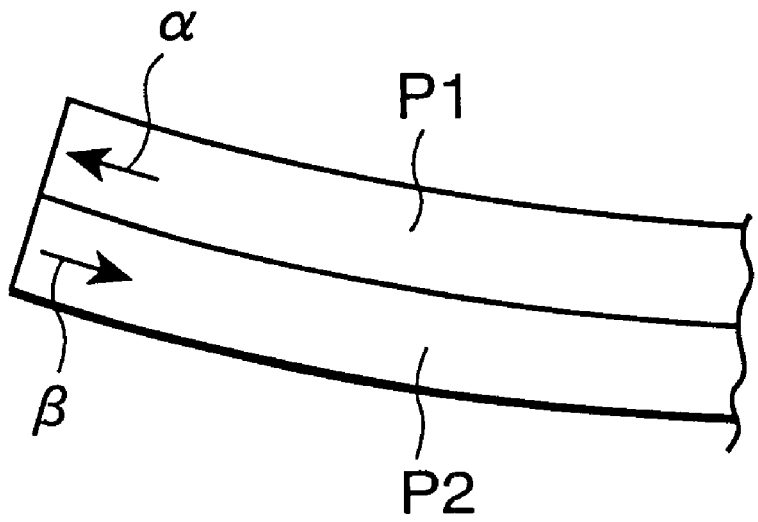
FIGS. 11A and 11B are explanatory diagrams showing how sheets of paper are separated.
Figure 11B:
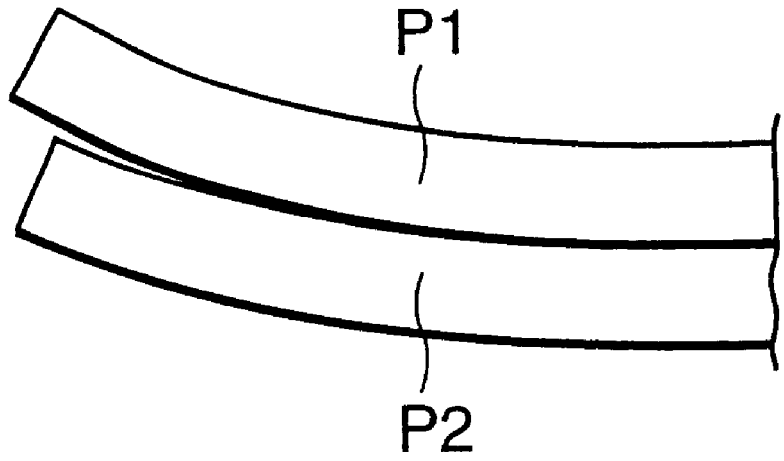

More specifically, if the uppermost sheet P1 and the sheet P2 immediately beneath it firmly sticking together are warped, a stress $\alpha$ occurs in the uppermost sheet P1 resisting a compressive force exerted on it while a stress $\beta$ occurs in the sheet P2 immediately beneath resisting a tensile force exerted on it as depicted in FIG. 11A. These stresses $\alpha$, $\beta$ increase as the curvatures of the sheets P1, P2 increase. When a combination of the stresses $\alpha$, $\beta$ becomes larger than the electrostatic force which acts to bind the two sheets P1, P2 together, their ends slide over each other so that the sheets P1, P2 are separated as shown in FIG. 11B.

Since the streams of air blown from the separating nozzles 30 provided at the central part of the air duct 20 against the bottom of the vacuum paper carrier 16 and reflected therefrom prevent the central part of each sheet from lifting, the aforementioned effect of producing the difference in curvature between the sheets P1 and P2 by warping of the upper sheets P1, P2 is evidently obtained. Furthermore, since the pressure of air blown from the central separating nozzles 30 onto the central part of the top surface of the uppermost sheet P1 keeps the uppermost sheet P1 covering the top side of the sheet P2, the lift of the left and right ends of the sheet P2 is restricted by the uppermost sheet P1.

Thus, with the lift of the sheet P2 restricted by the pressure of air blown from the separating nozzles 30 provided at the central part of the air duct 20 of the paper separator 15, the uppermost sheet P1 and the sheet P2 immediately beneath it are effectively separated from each other by the pressure of air blown from the separating nozzles 30 provided near the upstream and downstream ends of the air duct 20, and the sheet P2 is prevented from being attracted to the bottom of the paper-feed belts 34 of the vacuum paper carrier 16 together with the uppermost sheet P1.

The lifting nozzles 28, 29 of the paper separator 15 blow air with different pressures. Since the pressure of air blown from the lifting nozzle 28 closer to the blower 22 is higher than the pressure of air blown from the lifting nozzle 29, one side end of the sheet P1 designated "a" in FIG. 10 ascends higher than the other side end of the sheet P1 designated "b" as illustrated. Suction force produced by drawing air from within the vacuum duct 33 of the vacuum paper carrier 16 is largest at its end connected to the vacuum pump 46, where the side end "a" of the sheet P1 is located, and tends to become smaller toward the other side end "b" of the sheet P1. Due to this tendency, the side end "a" of the sheet P1 is first sucked by the vacuum paper carrier 16 and, therefore, the sheet P1 is sucked sequentially widthwise from the side end "a" toward the other side end "b".

Subsequently, the air blown from the separating nozzles 30 of the paper separator 15 flows along the bottom side of the uppermost sheet P1 which is attracted to the bottom of the paper-feed belts 34 of the vacuum paper carrier 16, so that only the uppermost sheet P1 sucked to the bottom of the paper-feed belts 34 is fed to the paper transport mechanism 4 of the image forming apparatus 1 with the sheet P1 reliably separated from the sheet P2 immediately beneath it.

On the other hand, the rear left and right portions of the uppermost sheet P1 are pushed down with a relatively small force by the second paper pushers 18 provided downstream of the air streams blown from the lifting nozzles 28, 29. Since the rear left and right portions of the uppermost sheet P1 are allowed to ascend to a certain extent, air blown in between the sheets P1 and P2 is evenly distributed to the left and right sides of the sheets P1 and P2 and flows toward their trailing ends while the first paper pusher 17 exerts a pushing force on the uppermost sheet P1 to prohibit fluttering of its rear end. As a consequence, the uppermost sheet P1 and the sheet P2 immediately beneath it are separated from each other in a reliable fashion.

Now, the internal paper-feed unit 12 is described below in detail, in which elements equivalent to those of the above-described external paper-feed unit 11 are designated by the same reference numerals and their detailed description is omitted. As shown in FIG. 1, the internal paper-feed unit 12 is provided with a first paper bin 58 situated on a forward side (downstream side) of paper-feeding direction, a second paper bin 59 situated on a rearward side (upstream side) of the paper-feeding direction, and a paper transfer assembly 60 which transfers the uppermost sheet from a stack of paper P loaded in the second paper bin 59 to the first paper bin 58. When all sheets of the stack P in the first paper bin 58 have been used up, the paper transfer assembly 60 is activated to convey the uppermost sheet from the stack of paper P in the second paper bin 59 onto a stacker plate in the first paper bin 58.

Figure 8:
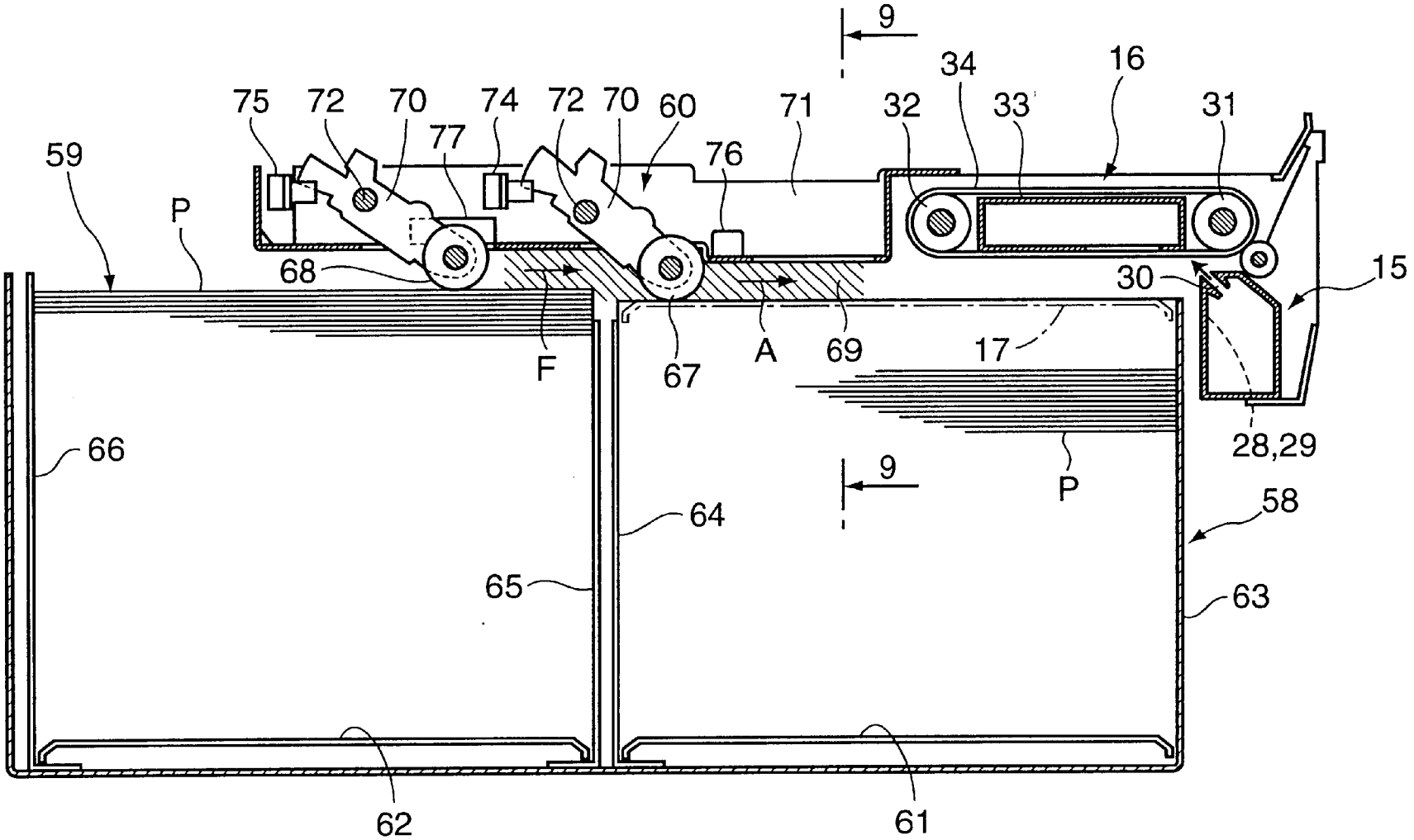
FIG. 8 is a cross-sectional view showing a construction of an internal paper-feed unit.

As shown in FIG. 8, the first and second paper bins 58, 59 are provided with stacker plates 61, 62 on which stacks of paper P of specific sizes are loaded, a pair of left and right stopper plates (not shown) for restricting lateral movements of the stacks of paper P loaded on the stacker plates 61, 62, front stopper plates 63, 65 and rear stopper plates 64, 66 for restricting forward and rearward movements of the stacks of paper P, respectively. Driven to ascend and descend by unillustrated elevation drive mechanisms, the stacker plates 61, 62 move the upper surfaces of the stacks of paper P up to a position from where a vacuum paper carrier 16 of the internal paper-feed unit 12 feeds the uppermost sheet and to a position from where the paper transfer assembly 60 transfers the uppermost sheet, respectively, according to consumption of sheets of paper.

When all sheets of paper loaded on the stacker plate 61 of the first paper bin 58 have been used, the stacker plate 61 ascends up to its uppermost guide position shown by an imaginary line (alternate long and short dashed line) in FIG. 8, whereby the stacker plate 61 serves as a guide plate for sheets of paper transferred from the second paper bin 59 on the upstream side. When all sheets of paper stacked in both the first and second paper bins 58, 59 have been used up, the stacker plates 61, 62 are caused to descend to their lowest paper loading positions.

The vertical dimension of the rear stopper plate 64 provided on the downstream side of the first paper bin 58 is made such that an upper end of the rear stopper plate 64 is located slightly lower than the stacker plate 61 at its uppermost guide position, e.g., approximately 15 mm below a top surface of the stacker plate 61, thereby providing a paper path for sheets of paper transferred from the second paper bin 59 on the downstream side. In addition, the front stopper plate 63 provided on the upstream side of the first paper bin 58 and the front stopper plate 65 provided on the upstream side of the second paper bin 59 are mounted such that their upper ends are located approximately at the same height as the rear stopper plate 64 of the first paper bin 58 to thereby provide a continuous paper path.

The paper transfer assembly 60 includes two sets of first paper pushers, one formed of a pair of first transfer rollers 67 located above the first paper bin 58 and the other formed of a pair of second transfer rollers 68 located above the second paper bin 59, and second paper pushers formed of a pair of elongate brushes 69 disposed to span over the first paper bin 58 and the second paper bin 59. The first and second transfer rollers 67, 68 are rotatably mounted at ends of respective brackets 70 which are swingably supported by respective rotary shafts 72 provided in a supporting frame 71.

Figure 9:
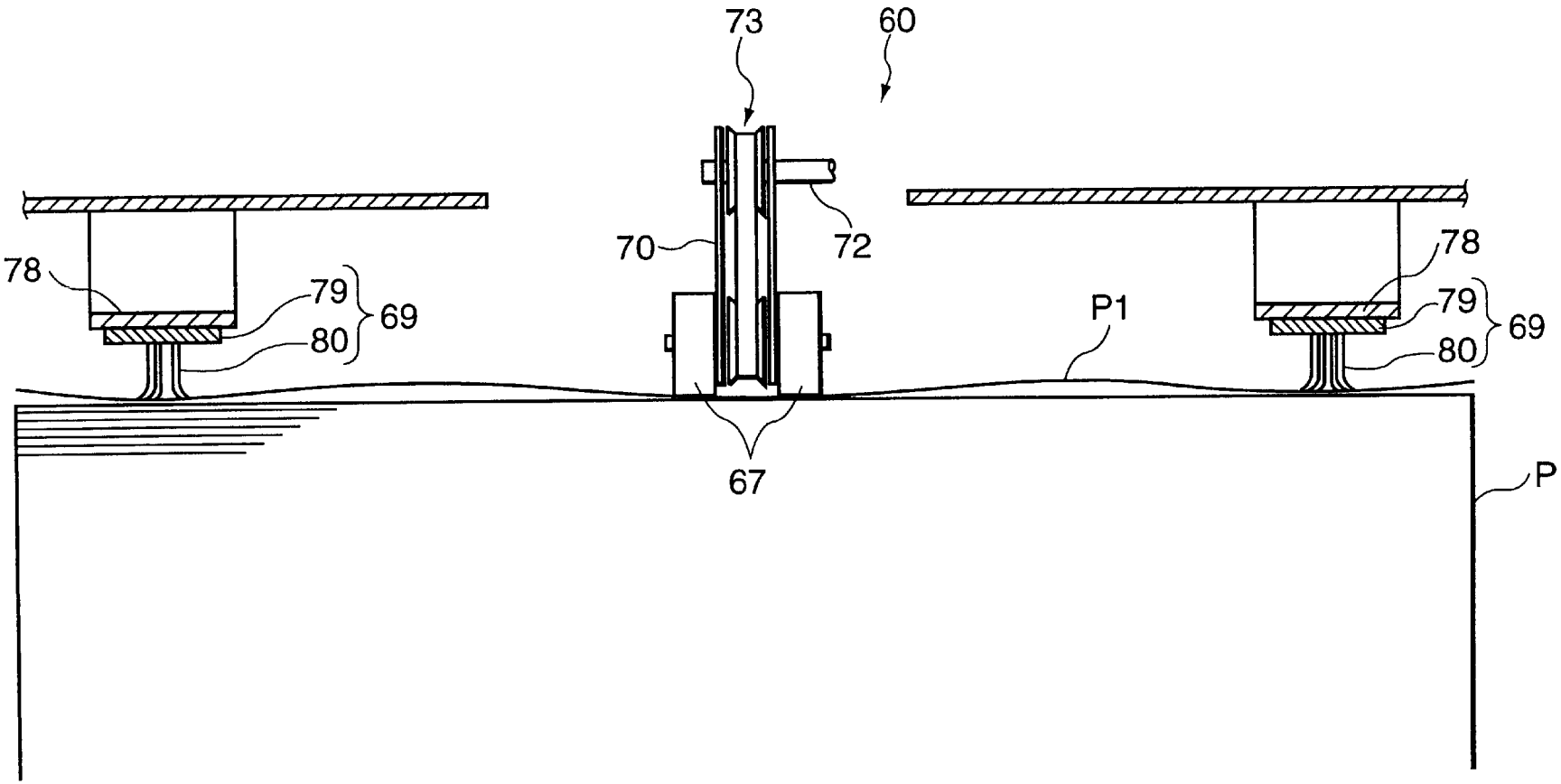
FIG. 9 is a cross-sectional view taken along the line 9—9 in FIG. 8.

The paper transfer assembly 60 is installed to align with the longitudinal center line of the stacks of paper P loaded in the first and second paper bins 58, 59. Referring to FIG. 9, the rotary shaft 72 is turned by unillustrated driving means including an electric motor, for example. The rotational driving force supplied from the driving means is transmitted to the first transfer rollers 67 via gear and clutch mechanisms (not shown) to rotate the first transfer rollers 67.

More specifically, a power transmission device 73 including a driving belt and pulleys is provided between two plates of the bracket 70 as illustrated in FIG. 9, and this power transmission device 73 drives the first transfer rollers 67 to rotate in the paper-feeding direction. As the first transfer rollers 67 are turned by the driving force transmitted from the rotary shaft 72 with the first transfer rollers 67 held in contact with the uppermost sheet P1 by their own weight, the uppermost sheet P1 is transferred in the direction of arrow F shown in FIG. 8. Since the second transfer rollers 68 located above the second paper bin 59 have the same construction as the first transfer rollers 67, their description is omitted.

The supporting frame 71 of the paper transfer assembly 60 is equipped with first and second upper-limit detecting switches 74, 75 including photosensors for detecting upper-limit positions of the stacks of paper P loaded in the first and second paper bins 58, 59, respectively, and first and second empty sensors 76, 77 including photosensors for detecting whether any sheets are present on the stacker plates 61, 62, respectively, by sensing light beams reflected by top surfaces of the stacks of paper P.

The brushes 69 of the paper transfer assembly 60 are suspended close to both side ends of the stack of paper P by means of respective mounting plates 78 as shown in FIG. 9, at rearward part (upstream part) of the first paper bin 58 with respect to the paper-feeding direction as illustrated in FIG. 8. Each of the brushes 69 is made by setting nylon fibers of a fineness of 450 deniers, for example, in a base 79 which is attached to the pertinent mounting plate 78 with double-faced tape or the like.

The brushes 69 installed with far ends of tuft portions 80, or free ends of the nylon fibers, slanted as shown in FIGS. 8 and 9 are constructed such that they are forced against the top side of the uppermost sheet P1 in the first and/or second paper bin 58, 59 or against the top side of a sheet being transferred from the second paper bin 59 to the stacker plate 61 of the first paper bin 58 with a force smaller than pushing force exerted by the first and second transfer rollers 67, 68. The brushes 69 are located downstream of lifting nozzles 28, 29 of a paper separator 15 of the internal paper-feed unit 12 with respect to the direction of streams of air blown from the lifting nozzles 28, 29. The paper separator 15 and vacuum paper carrier 16 of the internal paper-feed unit 12 have the same construction and work in the same manner as those provided in the external paper-feed unit 11.

As thus far described, the paper separator 15 has the lifting nozzles 28, 29 for lifting the left and right ends of the upper sheets P1, P2, for example, by blowing air against side end portions (excluding the central portion) of the stack of paper P loaded in the paper bin 14 (58, 59) in the paper-feed unit 11 (12) of the invention, which is provided with the paper separator 15 for lifting the uppermost sheet P1 and separating the uppermost sheet P1 from the sheet P2 immediately beneath by blowing air against the upper-forward end of the stack of paper P loaded in the paper bin 14 (58, 59) and the vacuum paper carrier 16 for sucking and conveying the uppermost sheet P1 which has ascended. This construction makes it possible to cause the upper sheets P1, P2 to warp by lifting their side ends with the pressure of air blown from the lifting nozzles 28, 29, thereby producing a difference in curvature between the uppermost sheet P1 and the sheet P2 immediately beneath it and effectively separating the sheets P1, P2 from each other.

Accordingly, unlike conventional paper feeders in which a plurality of lifting nozzles provided at regular intervals along an air duct blow air against the upper-forward end of a stack of paper loaded in a paper bin with approximately an even air pressure all along the width of the paper, the present invention does not cause paper feed problems, such as multiple feeds in which the uppermost sheet P1 and the sheet P2 beneath it, for instance, are fed simultaneously as they stick together by electrostatic force. Thus, the paper-feed units 11, 12 of the invention can properly feed the uppermost sheet P1 alone to the image-forming section 9 of the image forming apparatus 1.

Especially because the paper separator 15 has a pair of lifting nozzles 28, 29 for lifting the left and right ends of the upper sheets P1, P2, for example, by blowing air against the left and right end portions of the stack of paper P loaded in the paper bin 14 (58, 59) in the foregoing embodiment, it is possible to lift the left and right ends of the upper sheets P1, P2 by blowing air against the side end portions (excluding the central portion) of the stack of paper P loaded in the paper bin 14 (58, 59) and thereby cause the sheets P1, P2 to warp about their central portions. Thus, it is possible to separate the uppermost sheet P1 and the sheet P2 beneath it from each other more effectively.

Furthermore, when the paper separator 15 has the separating nozzles 30 which blow air at least onto the central portion of the stack of paper P loaded in the paper bin 14 (58, 59) to prevent the upper sheets P1, P2 from ascending as in the foregoing embodiment, the central portions of the sheets P1, P2 are kept from ascending by the pressure of air blown from the separating nozzles 30. Since a noticeable difference in the amount of rise occurs between the side end portions and central portions of the upper sheets P1, P2 with the arrangement, it is possible to cause the sheets P1, P2 to considerably warp and thereby separate the uppermost sheet P1 and the sheet P2 beneath it from each other in a more reliable fashion.

Furthermore, since the uppermost sheet P1 which is kept from ascending by the pressure of air blown from the separating nozzles 30 covers the top side of the sheet P2 preventing its side ends from lifting, the two upper sheets P1, P2 are effectively prevented from ascending together. Therefore, the uppermost sheet P1 and the sheet P2 beneath it are effectively separated from each other by the pressure of air blown from the separating nozzles 30 provided near the upstream and downstream ends of the air duct 20 and, as a consequence, there is produced an advantage that the sheets P1, P2 can be more effectively prevented from being fed together by the vacuum paper carrier 16.

Also, when the lifting nozzles 28, 29 are formed near the upstream and downstream ends of the air duct 20 of the paper separator 15, respectively, with the blower 22 joined to the upstream end of the air duct 20 such that the pressure of air blown from the lifting nozzle 28 toward one side end "a" of the uppermost sheet P1 becomes higher than the pressure of air blown from the lifting nozzle 29 toward the other side end "b" of the uppermost sheet P1 as seen in the foregoing embodiment, the side end "a" of the uppermost sheet P1 can be lifted higher than the other side end "b". With this arrangement, the uppermost sheet P1 can be separated from the sheet P2 beneath it as if peeling the sheet P1 from its side end "a" toward the other side end "b", resulting in an increase in the effect of separating the sheet P1.

Furthermore, since the suction force produced by the vacuum paper carrier 16 is made larger at the side end "a" of the uppermost sheet P1 than at the opposite side end "b" by locating the vacuum pump 46 for drawing air from within the vacuum duct 33 constituting the vacuum paper carrier 16 on the same side as the blower 22 of the paper separator 15 in the foregoing embodiment, the sheet P1 is first sucked at its side end "a" by the vacuum paper carrier 16 and then sucked sequentially toward the opposite side end "b". This serves to further increase the effect of separating the sheet P1.

Moreover, since the suction force produced by the vacuum paper carrier 16 is made large at one side end "a" of the uppermost sheet P1 and small at the opposite side end "b" in the present embodiment as seen above, it is possible to effectively prevent formation of wrinkles in the sheet P1, which is likely to occur if the left and right end portions of the sheet P1 are first sucked to the bottom of the vacuum paper carrier 16 at the same time and the central portion of the sheet P1 is subsequently sucked to the bottom of the vacuum paper carrier 16. Thus, the invention confers an advantage that the uppermost sheet P1 can be sucked by the vacuum paper carrier 16 in a proper fashion.

As an extreme example of construction which makes the pressure of air blown from a lifting nozzle(s) of the air duct 20 against one side end "a" of the stack of paper P higher than the pressure of air blown against the other side end "b", the lifting nozzle(s) may be formed in the vicinity of only the upstream end or downstream end of the air duct 20. Alternatively, opening areas of the suction holes 41–44 in the vacuum duct 33 may be varied such that the suction force exerted by the vacuum paper carrier 16 on one side end "a" of the uppermost sheet P1 becomes higher than that exerted on the other side end "b" of the uppermost sheet P1.

As shown in the foregoing discussion, each of the paper-feed units 11, 12 in which sheets of paper are separated and fed one after another from the stack of paper P loaded in the paper bin 14 (58, 59) comprises the multiple paper-feed belts 34 arranged at right angles to the paper-feeding direction, the paper-feed belts 34 having air-passing capability and driven in the paper-feeding direction, the vacuum paper sucker including the vacuum pump 46, the tubular joint 47 and the vacuum duct 33 which are provided inside the paper-feed belts 34 for sucking a sheet coming closest to the paper-feed belts 34 from the stack of paper P and holding the sheet onto the paper-feed belts 34, and the frictional contact members (elastic friction members) formed of the retard members 81 which are located just between the adjacent paper-feed belts 34 and exert frictional resistance on the sheet sucked onto the paper-feed belts 34 by going into contact with the sheet from its side facing the stack P. With this construction, when the paper-feed belts 34 carry the sheet which has been lifted from the stack of paper P and held by the paper-feed belts 34 by the suction force provided by the vacuum paper sucker, the retard members 81 come in contact with the sheet from the side of the stack P, thereby producing frictional resistance acting against the forward movement the sheet.

Therefore, even when a plurality of sheets, such as the sheets P1 and P2, are sucked by the paper-feed belts 34, it is possible to prevent the multiple paper sheet feed problem by separating the sheet P2 located closer to the stack P from the uppermost sheet P1, which is directly held by the paper-feed belts 34, by the frictional resistance exerted by the retard members 81. Since the retard members 81 are positioned just between the adjacent paper-feed belts 34, it is possible to avoid such an undesirable situation that a sheet becomes stuck between the retard members 81 and the paper-feed belts 34 and receives an excessive frictional resistance, which could occur when the individual retard members 81 are situated face to face with the paper-feed belts 34. This produces an advantage that damage to the sheets and accelerated wear of the elastic friction members can be effectively avoided.

Furthermore, since the elastic friction members formed of the multiple retard members 81 are arranged side by side in the direction perpendicular to the paper-feeding direction in left-right symmetry with respect to the longitudinal center line (axis of symmetry) of each sheet in the foregoing embodiment, the multiple retard members 81, which come in contact with a sheet sucked and conveyed by the paper-feed belts 34 from the side of the stack P, exert the frictional resistance symmetrically in the lateral direction of the sheet that is perpendicular to the paper-feeding direction. Thus, the arrangement of the invention is advantageous in that it can effectively avoid feeding an obliquely-oriented sheet, for instance, which could occur if the frictional resistance exerted on the sheet is biased to, or concentrated on, one side end portion of the sheet.

Furthermore, since the paper-feed belts 34 are mounted on the multiple pairs of rollers 31, 32, each having a barrellike shape swelling at the middle of its length, and the ribs 82, which come in contact with the paper-feed belts 34 causing the bottom side of the paper-feed belts 34 to swell downward toward the stack of paper P at the middle of the width of each belt 34, are provided inside the paper-feed belts 34 in the foregoing embodiment, the middle of the width of each belt 34 is caused to swell toward the stack of paper P. Thus, when the uppermost sheet P1 closest to the paper-feed belts 34 is sucked thereto, the sheet P1 is caused to warp toward the inner space of the paper-feed belts 34 at gaps between the adjacent paper-feed belts 34 according to their swelling shape.

On the other hand, since suction force exerted on the second sheet P2 and other sheets beneath the uppermost sheet P1 is relatively small, they do not warp as much as the sheet P1 and, therefore, there are created gaps between the sheet P1 and the second sheet P2 and the sheets beneath it. Accordingly, the effect of separating the sheets produced by the elastic friction members formed of the retard members 81 is significantly enhanced.

Furthermore, since the paper-feed unit 11 (12) is constructed such that the paper-feed belts 34 are located above the stack of paper P to suck and convey only the uppermost sheet P1 of the stack P as seen in the foregoing embodiment, it is possible to prevent the weight of the second sheet P2 and the sheets beneath it from acting on the uppermost sheet P1 as it is sucked by the paper-feed belts 34. It is therefore possible to easily separate the second sheet P2 and the sheets beneath it from the uppermost sheet P1 and thereby avoid multiple paper sheet feeds effectively.

While the invention has thus far been described with reference to its preferred embodiment in which the elastic friction members formed of the retard members 81 are attached to the air duct 20 of the paper separator 15, their mounting positions may be altered if the elastic friction members can be provided at appropriate positions between the paper-feed belts 34. Furthermore, the material, shape and the number of the elastic friction members are not limited to what has been stated with reference to the foregoing embodiment. Rather, various variations and changes are possible to the above-described construction of the elastic friction members and their upper end position E may be set as appropriate depending on their material, shape and other properties.

Figure 12:
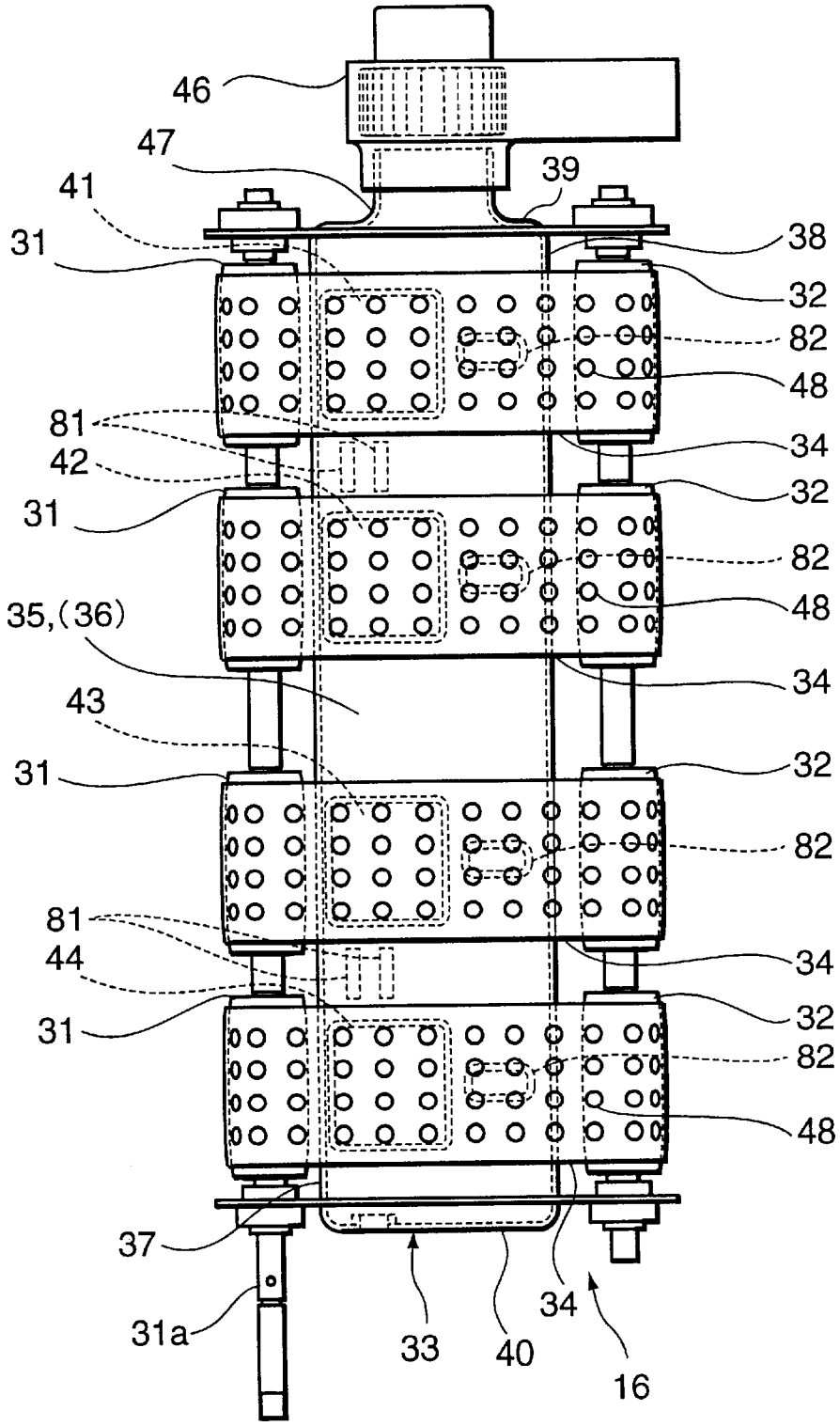
FIG. 12 is a plan view showing a vacuum paper carrier in one variation of the preferred embodiment.

As an alternative to the above-described construction of the preferred embodiment in which one each elastic friction member is provided between the adjacent paper-feed belts 34, there may be provided a plurality of elastic friction members (retard members 81) arranged in the paper-feeding direction between the adjacent paper-feed belts 34 as shown in FIG. 12. This alternative construction produces an advantage that the effect of separating the sheets by the frictional resistance produced by the elastic friction members is more enhanced because the multiple elastic friction members successively come in contact with the sheet being sucked and conveyed by the paper-feed belts 34.

Since the paper-feed unit 11 comprising the paper separator 15 which lifts the upper sheets of paper P1, P2, for example, and separates the uppermost sheet P1 from the second sheet P2 by blowing air against the upper-forward end of the stack of paper P loaded in the paper bin 14 and the vacuum paper carrier 16 for sucking and carrying the uppermost sheet P1 is provided with the first paper pusher 17 for pushing down the rear central portion of the sheet P1 at the top of the stack P loaded in the paper bin 14 and the second paper pushers 18 for pushing down the rear left and right portions of the uppermost sheet P1 with a smaller force than the first paper pusher 17 as shown in FIG. 7, it is possible to avoid fluttering of the rear end of the sheet P1, for instance, and allow the air for separating the uppermost sheet P1 from the sheet P2 immediately beneath to flow in the paper-feeding direction all along the length of the sheets.

More specifically, the first paper pusher 17 pushes down the rear central portion of the sheet P1 at the top of the stack P loaded in the paper bin 14 with a relatively strong force to prevent the sheet P1 and the sheets beneath it from lifting while the second paper pushers 18 push down the rear left and right portions of the uppermost sheet P1 with a relatively small force. This arrangement serves to maintain air streams flowing between the uppermost sheet P1 and the sheet P2 beneath it while effectively preventing fluttering of the rear end of the sheet P1, for instance. It is therefore possible to allow the air for separating each successive sheet to flow in the paper-feeding direction all along the length of the sheets.

Accordingly, the construction of the invention serves to effectively prevent oblique paper feeds and folding back of sheet ends which may occur due to misalignment of each sheet of paper caused by fluttering of the rear end of the sheets, enabling the vacuum paper carrier 16 to convey the uppermost sheet P1 in a proper manner. Moreover, as the construction of the invention allows the air blown in between the uppermost sheet P1 and the sheet P2 beneath it by the separating nozzles 30 of the paper separator 15 to flow in the paper-feeding direction all the way along the left and right end portions of the two sheets P1, P2, it is possible to reliably separate the uppermost sheet P1 from the sheet P2 beneath it and convey only the sheet P1 with the vacuum paper carrier 16, avoiding multiple feed of the sheets P1 and P2.

The second paper pushers 18 are made of platelike members which are supported by the pivot shafts 53 swingably about them in such a manner that the lower ends of the second paper pushers 18 push against the top side of the uppermost sheet P1 with their own weight in the foregoing embodiment. This confers an advantage that it is possible to apply an appropriate level of pushing force to the rear left and right portions of the uppermost sheet P1 with a simple construction.

Furthermore, since the paper separator 15 is provided the lifting nozzles 28, 29 which blow air in a direction opposite to the paper-feeding direction and the second paper pushers 18 are situated approximately on the lines extended downstream in the direction of the air streams blown from the lifting nozzles 28, 29 in the foregoing embodiment, lifting of the rear end of sheets due to the pressure of air blown from the lifting nozzles 28, 29 is avoided by the second paper pushers 18. This arrangement of the invention effectively prevents excessive lifting of the rear end of the sheets due to the air streams blown from the lifting nozzles 28, 29 and the air streams can be evenly distributed to the left and right sides of the sheets. This in turn helps to prevent fluttering of the rear end of the sheets more effectively.

When the internal paper-feed unit 12 provided with the first paper pushers formed of the transfer rollers 67, 68 and the second paper pushers formed of the brushes 69 as shown in FIGS. 8 and 9 is constructed such that the transfer rollers 67 (68) push down the rear central portion of the uppermost sheet P1 and the brushes 69 force the rear left and right portions of the uppermost sheet P1 down with a smaller force than the transfer rollers 67 (68), it is possible to obtain the same operational effects as described above.

Alternatively, the first and second paper pushers may be made of horizontally set flat strips or hanging ribbons of plastic-foam sponge, laminated sheets of polyethylene telephthalate (PET) film that can be forced against the uppermost sheet of paper, or clusters of film strips slanted in the paper-feeding direction.

In the paper-feed unit 11 (12) comprising the paper separator 15 having the lifting nozzles 28, 29 for lifting the upper sheets P1, P2, for instance, by blowing air against the upper-forward end of the stack of paper P loaded in the paper bin 14 (58, 59) and the vacuum paper carrier 16 for sucking and conveying the uppermost sheet P1 which has ascended, each of the lifting nozzles 28, 29 has the narrow opening portion (first opening portion 281, 291) for blowing air toward narrow areas including the uppermost parts of the stack of paper P loaded in the paper bin 14 (58, 59) and the wide opening portions (second opening portions 282, 292) for blowing air toward wider areas including the uppermost parts of the stack of paper P. This construction makes it possible to intensively loosen upper sheets of the stack P by the pressure of air blown toward the vertically narrow areas of its upper-forward end through the narrow opening portions of the lifting nozzles 28, 29 and lift the upper sheets up to the sucking part of the vacuum paper carrier 16 by the pressure of air blown toward the vertically wide areas of the upper-forward end of the stack P even when using a ream of recycled paper in which cut ends of individual sheets tend to stick together or a ream of paper whose individual sheets tend to stick together by electrostatic force.

While the physical dimensions of the vertically narrow first opening portions 281, 291 may be determined as appropriate depending on their opening area and distance to the facing surface of the uppermost sheet P1, their vertical dimension should preferably be made to fall within a range of 0.5 to 5 mm. This is because if the vertical dimension of the first opening portions 281, 291 is smaller than 0.5 mm, it is impossible to have air streams act on the uppermost sheet P1 when it curls, and if the vertical dimension is larger than 5 mm, it is impossible to produce a sufficient sheet-loosening effect.

Also, although the horizontal dimension of the first opening portions 281, 291 is not specifically limited, it is desirable that the horizontal dimension fall within a range of 5 to 50 mm. When the lifting nozzle 28 (29) is formed into an H shape having the second opening portions 282 (292) formed on the left and right sides of the first opening portion 281 (291) as seen in the foregoing embodiment, the horizontal dimension of the first opening portion 281 (291) should preferably be made to fall within a range of 5 to 20 mm.

On the other hand, while the physical dimensions of the vertically long second opening portions 282, 292 may be determined as appropriate depending on the location of the separating nozzles 30 and the distance between the stack of paper P and the vacuum paper carrier 16, for instance, their vertical dimension is determined within a range of about 2 to 20 mm, but larger than the vertical dimension of the first opening portions 281, 291. If the vertical dimension of the second opening portions 282, 292 is smaller than the values stated above, it is impossible to lift the uppermost sheet P1 up to a proper position where the air streams blown from the separating nozzles 30 could reach. If the vertical dimension of the second opening portions 282, 292 is larger than the values stated above, on the contrary, the sheet once sucked by the vacuum paper carrier 16 may blown off the vacuum paper carrier 16.

While it is possible to lift and separate the uppermost sheet P1 in a proper fashion if the distance c between the right end "a" of the uppermost sheet P1 and the right end "b" of the lifting nozzle 28 and the distance d between the left end "b" of the uppermost sheet P1 and the left end "b" of the lifting nozzle 29 shown in FIG. 10 are both equal to or smaller than 40 mm, it is preferable to made these distances c, d equal to or smaller than 20 mm. This is because it becomes impossible to properly warp the uppermost sheet P1 of the stack of paper P if the distances c, d are too large.

Figure 13E:
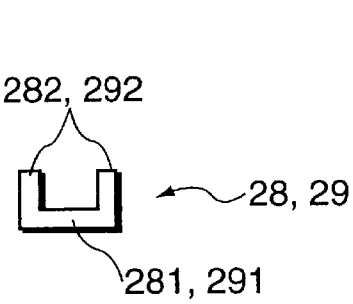
FIGS. 13A–13H are diagrams showing variations of lifting nozzles.
Figure 13F:
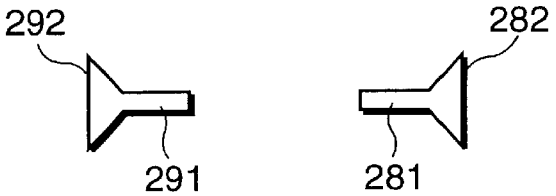
Figure 13G:
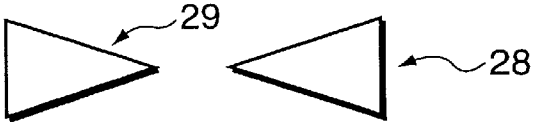
Figure 13H:
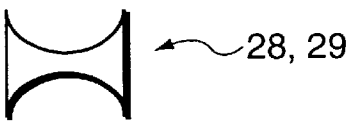
Figure 13A:
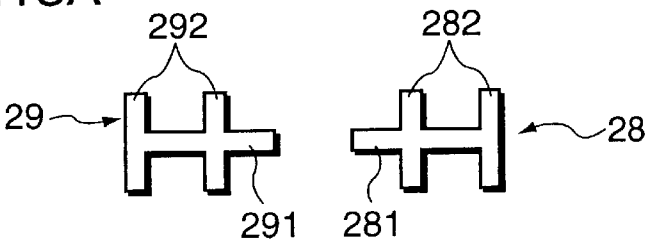
Figure 13B:
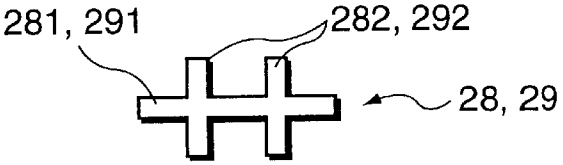
Figure 13C:
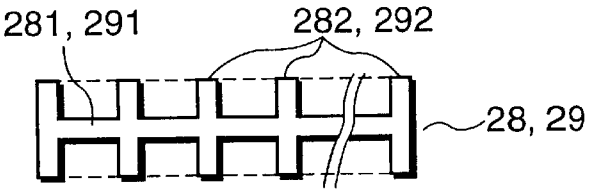
Figure 13D:
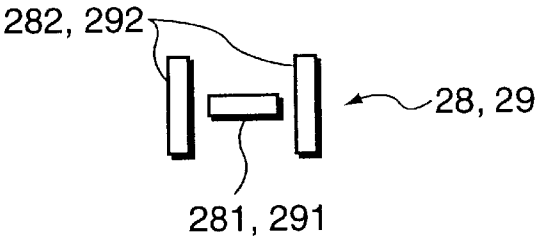

While the lifting nozzles 28, 29 are individually formed into an H shape in the foregoing embodiment, the shape of the lifting nozzles 28, 29 may be varied in various ways as appropriate as illustrated in FIGS. 13A–13H. FIGS. 13A and 13B show examples in which the horizontal dimension of vertically narrow first opening portions 281, 291 is increased to laterally extend beyond the second opening portions 282, 292. FIG. 13C shows an example in which a larger number of second opening portions 282, 292 are horizontally arranged at regular intervals to face the forward end of the stack of paper P with these second opening portions 282, 292 joined by a single first opening portion 281 (291). FIG. 13D shows an example in which one each first opening portion 281, first opening portion 291 and second opening portion 282 (292) separated from each other are combined to together form a generally H shape.

FIG. 13E shows an example in which bottom ends of left and right second opening portions 282, 292 are joined to each other by a single first opening portion 281 (291) together forming a U shape. Further, FIG. 13F shows an example in which second opening portions 282, 292 are individually formed into a triangular shape, and FIG. 13G shows an example in which lifting nozzles 28, 29 are individually formed into a triangular shape, the lifting nozzle 28 and the lifting nozzle 29 constituting first and second opening portions, respectively. In addition, FIG. 13H shows an example in which a central first opening portion and left and right second opening portions are joined together with curved lines.

In the paper-feed unit 11 (12), the lifting nozzles 28, 29, each having the narrow opening portion (first opening portions 281, 291) and the wide opening portions (second opening portions 282, 292), are provided in front of (immediately downstream of) the side end portions of the stack of paper P loaded in the paper bin 14 (58, 59) as indicated in the foregoing description of the embodiment. This construction is advantageous in that air streams blown from the lifting nozzles 28, 29 lift the left and right ends of upper sheets of the stack of paper P, causing the upper sheets to warp about their central portions, such that the uppermost sheet P1 can be separated from the sheet P2 beneath it more effectively.

In the paper-feed unit 11 (12) of the foregoing embodiment, there are provided the first paper pusher 17 (transfer rollers 67, 68) for pushing down the rear central portion of the sheet P1 at the top of the stack of paper P loaded in the paper bin 14 (58, 59) and the second paper pushers 18 (brushes 69) for pushing down the rear left and right portions of the uppermost sheet P1 with a smaller force than the first paper pusher 17 (transfer rollers 67, 68). With this arrangement, the first paper pusher 17 (transfer rollers 67, 68) pushes down the rear central portion of the uppermost sheet P1 of the stack of paper P loaded in the paper bin 14 (58, 59) with a relatively strong force, preventing the upper sheets from lifting, while the second paper pushers 18 (brushes 69) push down the rear left and right portions of the uppermost sheet P1 with a relatively small force, effectively preventing fluttering of the rear end of the upper sheets. Therefore, this arrangement is advantageous in that it serves to maintain air streams flowing between the uppermost sheet P1 and the sheet P2 beneath it and allow the air for separating each successive sheet to flow in the paper-feeding direction all along the length of the sheets.

As described above, an inventive paper feeder is provided with a paper separator for lifting upper sheets of paper and separating the uppermost sheet from the sheet immediately beneath it by blowing air against an upper-forward end of a stack of paper loaded in a paper bin, and a vacuum paper carrier for holding the uppermost sheet by suction and carrying it. The paper separator has a lifting nozzle for lifting side ends of the upper sheets by blowing air toward side portions, excluding a central portion, of the stack of paper loaded in the paper bin.

Since the upper sheets are caused to warp with their side ends lifted by blowing air toward the side portions, excluding the central portion, of the stack of paper loaded in the paper bin from the lifting nozzle of the paper separator in this construction, the uppermost sheet is effectively separated from the sheet immediately beneath it without unnecessarily increasing the pressure of air. Thus, it is possible to prevent multiple paper sheet feeds which occur when more than one sheet of paper is sucked simultaneously by the vacuum paper carrier.

In addition, this construction causes the upper sheets to warp by the pressure of air blown from the lifting nozzle, producing a difference in curvature between individual sheets. Thus, this construction is advantageous in that even when the uppermost sheet and the sheets beneath it are stuck together by electrostatic force, for instance, it is possible to separate the uppermost sheet and thereby prevent multiple paper sheet feeds.

The paper feeder may be constructed such that the paper separator has a pair of lifting nozzles for lifting the left and right ends of the upper sheets by blowing air toward the left and right end portions of the stack of paper loaded in the paper bin.

Since the left and right ends of the upper sheets are lifted causing the upper sheets to warp about their central portions by blowing air toward the left and right end portions, excluding the central portion, of the stack of paper loaded in the paper bin from the lifting nozzles of the paper separator in this construction, it is possible to separate the uppermost sheet and the sheet beneath it from each other more effectively.

The paper feeder may be constructed such that the paper separator has a separating nozzle for blowing air at least toward the central portion of the stack of paper to prevent the upper sheets from ascending.

Since the side ends of the upper sheets are lifted by the pressure of air blown from the lifting nozzles of the paper separator toward the upper-forward end of the stack of paper loaded in the paper bin while the central portions of the upper sheets are kept from ascending by the pressure of air blown from the separating nozzle in this construction, a noticeable difference in the amount of rise occurs between the side end portions and central portions of the upper sheets. As a result, the upper sheets are caused to considerably warp, making it possible to separate the uppermost sheet and the sheet beneath it in a more reliable fashion.

The paper feeder may be constructed such that the pressure of air blown by the lifting nozzle of the paper separator toward one side portion of the stack of paper is made higher than the pressure of air blown toward the other side portion of the stack of paper.

According to this construction, one side end portion of the uppermost sheet is lifted higher than the other side end portion by the differentiated pressure of air blown from the lifting nozzle of the paper separator toward the side portions of the upper-forward end of the stack of paper loaded in the paper bin. As a result, the uppermost sheet can be separated from the sheet beneath it as if peeling the uppermost sheet from its one side end toward the other side end.

The paper feeder may be constructed such that suction force exerted by the vacuum paper carrier on the uppermost sheet is larger at its one side end portion than at its other side end portion.

Since one side end portion of the uppermost sheet, which has been lifted by the pressure of air blown from the lifting nozzle of the paper separator toward the side portions of the upper-forward end of the stack of paper loaded in the paper bin, is sucked to the bottom the vacuum paper carrier with a stronger suction force in this construction, the uppermost sheet is first sucked at its side end and then sucked sequentially toward the opposite side end in a proper fashion.

Another inventive paper feeder in which sheets of paper are separated and fed one after another from a stack of paper comprises a plurality of paper-feed belts arranged at right angles to paper-feeding direction and driven in the paper-feeding direction. The paper-feed belts have air-passing capability. Further, there are provided a vacuum paper sucker for sucking a sheet which has come closest to the paper-feed belts and holding the sheet onto the paper-feed belts, and an elastic friction member which is located between the adjacent paper-feed belts and exerts frictional resistance on the sheet sucked onto the paper-feed belts by going into contact with the sheet from its side facing the stack of paper. The frictional resistance acts in a direction opposite to the paper-feeding direction.

In this construction, when the paper-feed belts carry the sheet which has been lifted from the stack of paper and held by the paper-feed belts by the suction force provided by the vacuum paper sucker, the elastic friction member comes in contact with the sheet from the side of the stack of paper, thereby producing frictional resistance acting against the forward movement the sheet. Therefore, even when a plurality of sheets are sucked by the paper-feed belts, it is possible to prevent the multiple paper sheet feed problem as any sheets located closer to the stack of paper are separated from the uppermost sheet, which is directly held by the paper-feed belts, by the frictional resistance exerted by the elastic friction member. Since the elastic friction member are positioned just between the adjacent paper-feed belts, it is possible to avoid such an undesirable situation that a sheet becomes stuck between the elastic friction member and the paper-feed belts and receives an excessive frictional resistance, which could occur when the elastic friction member is situated face to face with the paper-feed belts. This produces an advantage that damage to the sheets and accelerated wear of the elastic friction member can be effectively avoided.

This paper feeder may be constructed such that a plurality of elastic friction members are arranged in a direction perpendicular to the paper-feeding direction in left-right symmetry with respect to a center line of each sheet passing the center of its width.

In this construction, the multiple elastic friction members, which come in contact with a sheet sucked and conveyed by the paper-feed belts from the side of the stack of paper, exert the frictional resistance symmetrically in the lateral direction of the sheet that is perpendicular to the paper-feeding direction. Thus, this construction effectively avoids feeding an obliquely-oriented sheet, for instance, which could occur if the frictional resistance exerted on the sheet is biased to, or concentrated on, one side end portion of the sheet.

The paper feeder may be constructed such that each of the paper-feed belts is swollen toward the stack of paper at the middle of its width.

In this construction, when the uppermost sheet closest to the paper-feed belts is sucked thereto, the sheet is caused to warp toward the inner space of the paper-feed belts at gaps between the adjacent paper-feed belts according to their swelling shape. On the other hand, since suction force exerted on the second and lower sheets beneath the uppermost sheet is smaller, they do not warp as much as the uppermost sheet and, therefore, there are created gaps between the uppermost sheet and the sheets beneath it. Accordingly, the effect of separating the sheets produced by the elastic friction members is significantly enhanced.

One specific-construction for causing the paper-feed belts to swell toward the stack of paper at the middle of the width of each paper-feed belt is to mount them on rollers, each having a barrellike shape swelling at the middle of its length. Another specific-construction is to provide ribs which come into contact with the paper-feed belts from their inside, causing the paper-feed belts to swell toward the stack of paper at the middle of the width of each paper-feed belt.

The paper feeder may be constructed such that the paper-feed belts are located above the stack of paper to suck and convey each successive sheet located at the top of the stack of paper.

When the paper-feed belts suck and convey the uppermost sheet from the stack of paper, the weight of the second sheet and the sheets beneath it does not act on the uppermost sheet sucked by the paper-feed belts in this construction. It is therefore possible to easily separate the second sheet and the sheets beneath it from the uppermost sheet and thereby avoid multiple paper sheet feeds effectively.

Further, a plurality of elastic friction members may be arranged in the paper-feeding direction.

In this construction, the multiple elastic friction members successively come in contact with the sheet being sucked and conveyed by the paper-feed belts, so that the effect of separating the sheets by the frictional resistance produced by the elastic friction members is more enhanced.

Still another inventive paper feeder comprises a paper separator for lifting upper sheets of paper and separating the lifted uppermost sheet from the sheet immediately beneath it by blowing air against an upper-forward end of a stack of paper loaded in a paper bin, a vacuum paper carrier for holding the uppermost sheet by suction and carrying it, a first paper pusher for pushing down a rear central portion of the uppermost sheet at the top of the stack of paper loaded in the paper bin, and a second paper pusher for pushing down rear left and right portions of the uppermost sheet with a smaller force than the first paper pusher.

In this construction, the first paper pusher pushes down the rear central portion of the uppermost sheet at the top of the stack of paper loaded in the paper bin with a relatively strong force to prevent the uppermost sheet and the sheets beneath it from lifting while the second paper pusher pushes down the rear left and right portions of the uppermost sheet with a relatively small force. This serves to maintain air streams flowing between the uppermost sheet and the sheet beneath it while effectively preventing fluttering of the rear end of the sheets. It is therefore possible to allow the air for separating each successive sheet to flow in the paper-feeding direction all along the length of the sheets, and thus to separate the uppermost sheet from the sheet immediately beneath it effectively.

This paper feeder may be constructed such that the second paper pusher includes a platelike member sustained by a pivot shaft swingably about it, and an extreme end of the second paper pusher is held in contact with the top side of the uppermost sheet with the weight of the second paper pusher itself.

As the extreme end of the second paper pusher is held in contact with the top side of the uppermost sheet with the weight of the second paper pusher itself in this construction, an appropriate level of downward pushing force can be applied to the rear left and right portions of the uppermost sheet with a simple construction.

This paper feeder may be constructed such that the paper separator has a lifting nozzle for blowing air in a direction opposite to paper-feeding direction and the second paper pusher is situated approximately on a line extended downstream in the direction of an air stream blown from the lifting nozzle.

Since lifting of the rear end of the sheets due to the pressure of air blown from the lifting nozzle is avoided by the second paper pusher in this construction, it is possible to effectively prevent excessive lifting of the rear end of the sheets due to the air stream blown from the lifting nozzle and distribute the air stream evenly to the left and right sides of the sheets.

Still another inventive paper feeder comprises a lifting nozzle for lifting upper sheets of paper from a stack of paper loaded in a paper bin by blowing air against an upper-forward end of the stack of paper, and a vacuum paper carrier for holding the lifted uppermost sheet by suction and carrying it. The lifting nozzle has a narrow opening portion for blowing air toward a narrow area including the uppermost part of the stack of paper loaded in the paper bin and a wide opening portion for blowing air toward a wide area including the uppermost part of the stack of paper.

This construction makes it possible to intensively loosen the upper sheets of the stack of paper by the pressure of air blown toward the vertically narrow area of its upper-forward end through the narrow opening portion of the lifting nozzle and lift the upper sheets up to a sucking part of the vacuum paper carrier by the pressure of air blown toward the vertically wide areas of the upper-forward end of the stack of paper even when using a ream of recycled paper in which cut ends of individual sheets tend to stick together or a ream of paper whose individual sheets tend to stick together by electrostatic force. Thus, it is possible to properly separate the uppermost sheet and the sheets beneath it from the stack of paper loaded in the paper bin and convey the uppermost sheet alone, and to effectively avoid feeding an obliquely-oriented sheet, for instance, which could occur due to fluttering of the rear end of the sheets.

This paper feeder may be constructed such that the lifting nozzle is provided at a position facing a side portion of the stack of paper loaded in the paper bin.

In this construction, the lifting nozzle blows air against the left and right end portions, excluding the central portion, of the stack of paper loaded in the paper bin, so that the left and right ends of the upper sheets are lifted, causing the upper sheets to warp about their central portions. Since the left and right ends of the upper sheets are lifted causing the upper sheets to warp about their central portions by blowing air toward the left and right end portions, excluding the central portion, of the stack of paper loaded in the paper bin from the lifting nozzle in this construction, air can easily enter between the uppermost sheet and the sheet beneath it from their side ends and, as a consequence, the uppermost sheet can be separated from the sheet beneath it more effectively.

The paper feeder may be further provided with a first paper pusher for pushing down a rear central portion of the uppermost sheet at the top of the stack of paper loaded in the paper bin, and a second paper pusher for pushing down rear left and right portions of the uppermost sheet with a smaller force than the first paper pusher.

In this construction, the first paper pusher pushes down the rear central portion of the uppermost sheet at the top of the stack of paper loaded in the paper bin with a relatively strong force to prevent the uppermost sheet and the sheets beneath it from lifting while the second paper pusher pushes down the rear left and right portions of the uppermost sheet with a relatively small force. This serves to maintain air streams flowing between the uppermost sheet and the sheet beneath it while effectively preventing fluttering of the rear end of the uppermost sheet. It is therefore possible to allow the air for separating each successive sheet to flow in the paper-feeding direction all along the length of the sheets.

This application is based on patent application Nos. 2000-45913, 2000-45914, 2000-46320, and 2000-190413 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A paper feeder for feeding sheets of paper one after another from a stack of paper loaded in a paper bin, the paper feeder comprising:

a paper separator having a paper lifting nozzle for blowing lifting air to the stack of paper with the lifting air bing directed to an upper marginal portion of the stack such that marginal portions of the sheets of paper at the upper portion of the stack are lifted, and a paper separating nozzle for blowing separating air to a lifted sheet of paper to separate an uppermost paper from the sheet immediately below the uppermost paper, the paper separator being arranged such that the lifting air is not directed to a central portion of the paper stack with respect to a direction perpendicular to the direction of paper feeding; and a vacuum paper carrier which holds, by suction, the uppermost paper.

2. The paper feeder according to claim 1, wherein the paper separator has a pair of lifting nozzles for blowing lifting air to the stack of the paper with the lifting air being directed to the left and right marginal portions of the stack with respect to the direction perpendicular to the direction of the paper feeding.

3. The paper feeder according to claim 1, wherein the separating nozzle is arranged to blow the separating air to the central portion of the stack of paper to prevent the lifting of the upper sheets of paper at the central portion.

4. The paper feeder according to claim 1, wherein the paper separator has a pair of lifting nozzles for blowing lifting air to the stack of the paper with the lifting air being directed to the left and right marginal portions of the stack with respect to the direction perpendicular to the direction of the paper feeding and one of the pair of lifting nozzles is arranged to blow the lifting air with higher pressure than that blown by the other nozzle of the pair of lifting nozzles.

5. The paper feeder according to claim 1, wherein the vacuum paper carrier is arranged to exert, on the paper, a sanction force which varies in the direction perpendicular too the direction of paper feeding.

6. A paper feeder comprising:

a paper separator which lifts upper sheets of paper and separates the uppermost sheet from the sheet immediately beneath it by blowing air against an upper-forward end of a stack of paper loaded in a paper bin; and a vacuum paper carrier which holds the uppermost sheet by suction and carrying it;

wherein the paper separator has a lifting nozzle which lifts side ends of the upper sheets by blowing air toward side portions, excluding a central portion, of the stack of paper loaded in the paper bin, the paper separator has a pair of lifting nozzles which lift left and right ends of the upper sheets by blowing air toward left and right end portions of the stack of paper loaded in the paper bin, and one of the pair of lifting nozzles is arranged to blow the lifting air with higher pressure than that blown by the other nozzle of the pair of lifting nozzles.

7. A paper feeder comprising:

a paper separator which lifts upper sheets of paper and separates the uppermost sheet from the sheet immediately beneath it by blowing air against an upper-forward end of a stack of paper loaded in a paper bin; and a vacuum paper carrier which holds the uppermost sheet by suction and carrying it;

wherein the paper separator has a lifting nozzle which lifts side ends of the upper sheets by blowing air toward side portions, excluding a central portion, of the stack of paper loaded in the paper bin and the vacuum paper carrier is arranged to exert, on the paper, a sanction force which varies in the direction perpendicular too the direction of paper feeding.

8. A paper feeder in which sheets of paper are separated and fed one after another from a stack of paper, the paper feeder, the paper feeder comprising:

a plurality of paper-feed belts which are arranged at right angles to paper-feeding direction and driven in the paper-feeding direction, the paper-feed belts having air-passing capability;

a vacuum paper sucker which sucks a sheet having come closest to the paper-feed belts and holds the sheet onto the paper-feed belts; and an elastic friction member which is located between the adjacent paper-feed belts and exerts frictional resistance on the sheet sucked onto the paper-feed belts by going into contact with the sheet from its side facing the stack of paper, the frictional resistance acting in a direction opposite to the paper-feeding direction.

9. The paper feeder according to claim 8, wherein a plurality of elastic friction members are arranged in a direction perpendicular to the paper-feeding direction in left-right symmetry with respect to a center line of each sheet passing the center of its width.

10. The paper feeder according to claim 8, wherein each of the paper-feed belts is swollen toward the stack of paper at the middle of its width.

11. The paper feeder according to claim 10, wherein the paper-feed belts are mounted on rollers, each having a barrellike shape swelling at the middle of its length, such that the paper-feed belts swell toward the stack of paper.

12. The paper feeder according to claim 10, further comprising ribs which come into contact with the paper-feed belts from their inside, thereby causing the paper-feed belts to swell toward the stack of paper at the middle of the width of each paper-feed belt.

13. The paper feeder according to claim 8, wherein the paper-feed belts are located above the stack of paper to suck and convey each successive sheet located at the top of the stack of paper.

14. The paper feeder according to claim 8, wherein a plurality of elastic friction members are arranged in the paper-feeding direction.

15. A paper feeder comprising:

a paper separator which lifts upper sheets of paper and separates the lifted uppermost sheet from the sheet immediately beneath it by blowing air against an upper-forward end of a stack of paper loaded in a paper bin;

a vacuum paper carrier which holds the, uppermost sheet by suction and carrying it;

a first paper pusher which pushes down a rear central portion of the uppermost sheet at the top of the stack of paper loaded in the paper bin; and a second paper pusher which pushes down rear left and right portions of the uppermost sheet with a smaller force than the first paper pusher.

16. The paper feeder according to claim 15, wherein the second paper pusher includes a pair of plate members, each of the members being pivotably supported by a shaft, and the free ends of the plate members are held in contact with the top side of the uppermost sheet of paper by the weight of respective plate members.

17. The paper feeder according to claim 15, wherein the paper separator has a lifting nozzle which blows air in a direction opposite to paper-feeding direction and the second paper pusher is situated approximately on a line extended downstream in the direction of an air stream blown from the lifting nozzle.

18. A paper feeder for feeding sheets of paper one after another from a stack of paper loaded in a paper bin, the paper feeder comprising:

a paper lifting nozzle for blowing air against an upper-forward end of the stack of paper to lift the upper sheets of paper from the stack, the nozzle having a narrow opening through which air is blown to a narrow area of an uppermost portion of the stack of paper, and a wide opening larger than the narrow opening through which air is blown to a wide area of the uppermost portion of the stack of paper; and a vacuum paper carrier which holds the lifted uppermost sheet by suction and carries it.

19. The paper feeder according to claim 18, wherein the paper lifting nozzle is located at a position facing a marginal portion of the stack of paper with respect to a direction perpendicular to a direction of paper feeding.

20. The paper feeder according to claim 18, further comprising:

a first paper pusher which pushes down a rear central portion of the uppermost sheet at the top of the stack of paper loaded in the paper bin; and a second paper pusher which pushes down rear left and right portions of the uppermost sheet with a smaller force than the first paper pusher.

21. A paper feeder comprising:

a lifting nozzle which lifts upper sheets of paper from a stack of paper loaded in a paper bin by blowing air against an upper-forward end of the stack of paper;

a vacuum paper carrier which holds the lifted uppermost sheet by suction and carrying it;

a first paper pusher which pushes down a rear central portion of the uppermost sheet at the top of the stack of paper loaded in the paper bin; and a second paper pusher which pushes down rear left and right portions of the uppermost sheet with a smaller force than the first paper pusher, wherein the lifting nozzle includes a narrow opening portion for blowing air toward a narrow area having the uppermost part of the stack of paper loaded in the paper bin and a wide opening portion for blowing air toward a wide area having the uppermost part of the stack of paper.

22. A paper feeder in which sheets of paper are separated and fed one after another from a stack of paper, the paper feeder, the paper feeder comprising:

a plurality of paper-feed belts which are arranged side by side in the direction at right angles to a paper-feeding direction and driven in the paper-feeding direction, the paper-feed belts having air-passing capability;

a vacuum paper sucker which sucks a sheet of paper having come closest to the paper-feed belts and holds the sheet onto the paper-feed belts; and an elastic friction member which is located between the adjacent paper-feed belts and exerts frictional resistance on the sheet sucked on the paper-feed belts by coming into contact with the sheet from its side facing the stack of paper, the frictional resistance acting in a direction opposite to the paper-feeding direction.

23. The paper feeder according to claim 22, wherein a plurality of elastic friction members are arranged in a direction perpendicular to the paper-feeding direction in left-right symmetry with respect to a center line of each sheet passing the center of its width.

24. The paper feeder according to claim 22, wherein each of the paper-feed belts is swollen toward the stack of paper at the middle of its width.

25. The paper feeder according to claim 24, wherein the paper-feed belts are mounted on rollers, each having a barrellike shape swelling at the middle of its length, such that the paper-feed belts swell toward the stack of paper.

26. The paper feeder according to claim 24 further comprising ribs which come into contact with the paper-feed belts from their inside, thereby causing the paper-feed belts to swell toward the stack of paper at the middle of the width of each paper-feed belt.

27. The paper feeder according to claim 22, wherein the paper-feed belts are located above the stack of paper to suck and convey each successive sheet located at the top of the stack of paper.

28. The paper feeder according to claim 22, wherein a plurality of elastic friction members are arranged in the paper-feeding direction.

29. A paper feeder for feeding sheets of paper one after another from a stack of paper loaded in a paper bin, the paper feeder comprising:

a paper lifting nozzle for blowing air against an upper-forward end of the stack of paper to lift the upper sheets of paper from the stack, the nozzle having a at least one H-shaped opening through which air is blown to an area of an uppermost portion of the stack of paper; and a vacuum paper carrier which holds the lifted uppermost sheet by suction and carries it.

30. A paper feeder for feeding sheets of paper one after another from a stack of paper loaded in a paper bin, the paper feeder comprising:

a paper lifting nozzle for blowing air against an upper-forward end of the stack of paper to lift the upper sheets of paper from the stack, the nozzle having a at least one U-shaped opening through which air is blown to an area of an uppermost portion of the stack of paper; and a vacuum paper carrier which holds the lifted uppermost sheet by suction and carries it.

31. A paper feeder for feeding sheets of paper one after another from a stack of paper loaded in a paper bin, the paper feeder comprising:

a paper lifting nozzle for blowing air against an upper-forward end of the stack of paper to lift the upper sheets of paper from the stack, the nozzle having a at least one triangular-shaped opening through which air is blown to an area of an uppermost portion of the stack of paper; and a vacuum paper carrier which holds the lifted uppermost sheet by suction and carries it.

32. A paper feeder for feeding sheets of paper one after another from a stack of paper loaded in a paper bin, the paper feeder comprising:

a paper lifting nozzle for blowing air against an upper-forward end of the stack of paper to lift the upper sheets of paper from the stack, the nozzle having a at least one cone joining a bar-shaped opening through which air is blown to an area of an uppermost portion of the stack of paper; and a vacuum paper carrier which holds the lifted uppermost sheet by suction and carries it.

* * * * *